US008534577B2

(12) United States Patent
Dodson

(10) Patent No.: US 8,534,577 B2
(45) Date of Patent: Sep. 17, 2013

(54) FLAT JET WATER NOZZLES WITH ADJUSTABLE DROPLET SIZE INCLUDING FIXED OR VARIABLE SPRAY ANGLE

(76) Inventor: Mitch Dodson, Park City, UT (US)

( * ) Notice: Subject to any disclaimer, the term of this patent is extended or adjusted under 35 U.S.C. 154(b) by 0 days.

(21) Appl. No.: 12/998,141

(22) PCT Filed: Sep. 25, 2009

(86) PCT No.: PCT/US2009/005345

§ 371 (c)(1),
(2), (4) Date: Mar. 22, 2011

(87) PCT Pub. No.: WO2010/036372

PCT Pub. Date: Apr. 1, 2010

(65) Prior Publication Data

US 2011/0168808 A1 Jul. 14, 2011

(30) Foreign Application Priority Data

Sep. 25, 2008 (AU) ..... 2008904999

(51) Int. Cl.

| | |
|---|---|
| ***B05B 1/04*** | (2006.01) |
| ***B05B 1/14*** | (2006.01) |
| ***B05B 1/30*** | (2006.01) |
| *F25C 3/04* | (2006.01) |

(52) U.S. Cl.

USPC ..... 239/597; 239/14.2; 239/451; 239/460; 239/590.5; 239/592

(58) Field of Classification Search

USPC ..... 239/2.2, 14.2, 106, 119, 451, 456, 239/460, 583, 589, 589.1, 590, 590.5, 592, 239/594–598, 600

See application file for complete search history.

(56) References Cited

U.S. PATENT DOCUMENTS

| | | | | |
|---|---|---|---|---|
| 1,844,187 | A * | 2/1932 | Smith | 431/346 |
| 3,383,054 | A | 5/1968 | Nugarus | |
| 3,776,471 | A * | 12/1973 | Meyer et al. | 239/553.5 |

(Continued)

FOREIGN PATENT DOCUMENTS

| | | | |
|---|---|---|---|
| DE | 2855906 | A1 | 7/1980 |
| EP | 00824658 | B1 | 2/1998 |

(Continued)

OTHER PUBLICATIONS

Extended European Search Report for European Counterpart Application, Jan. 31, 2013, EP Application No. 09816598.8, PCT/US2009005345, European Patent Office, Munich Germany.

*Primary Examiner* — Darren W Gorman

(74) *Attorney, Agent, or Firm* — Paul C. Oestreich; Eminent IP, P.C.

(57) ABSTRACT

A nozzle comprises a lower nozzle plate including a lower impingement surface formed therein, at least one fluid intake port disposed at an inner end of the lower impingement surface, and an upper nozzle plate including an upper impingement surface formed therein and an upper orifice edge disposed along an outer end of the upper impingement surface. The nozzle includes a seal configured for sealing the lower nozzle plate to the upper nozzle plate, such that the lower and upper impingement surfaces are opposed toward one another, thereby forming a fluid channel between the impingement surfaces, directing pressurized fluid from the at least one fluid intake port to a slotted orifice formed between the opposed lower and upper orifice edges. The nozzle includes a droplet size adjustment mechanism configured for attachment to the upper and lower nozzle plates for selectively controlling fluid droplet size ejected from the slotted orifice.

19 Claims, 27 Drawing Sheets

(56) References Cited

U.S. PATENT DOCUMENTS

| | | | | |
|---|---|---|---|---|
| 4,141,507 | A | 2/1979 | Rump | |
| 4,145,000 | A | 3/1979 | Smith et al. | |
| 4,343,434 | A | 8/1982 | Haruch | |
| 4,349,156 | A | 9/1982 | Haruch et al. | |
| 4,383,646 | A | 5/1983 | Smith | |
| 4,442,047 | A | 4/1984 | Johnson | |
| 4,903,895 | A | 2/1990 | Mathewson et al. | |
| 5,064,118 | A | 11/1991 | Lauricella | |
| 5,135,167 | A | 8/1992 | Ringer | |
| 5,520,331 | A | 5/1996 | Wolfe | |
| 5,692,682 | A | 12/1997 | Soule et al. | |
| 5,699,961 | A | 12/1997 | Ratnik et al. | |
| 5,823,436 | A * | 10/1998 | Waldrum | 239/123 |
| 5,909,844 | A | 6/1999 | Nilsson | |
| 6,007,676 | A | 12/1999 | Bartels et al. | |
| 6,119,956 | A | 9/2000 | McKinney | |
| 6,129,290 | A | 10/2000 | Nikkanen | |
| 6,793,148 | B2 | 9/2004 | Ratnik | |
| 7,114,662 | B1 | 10/2006 | Nikkanen | |
| 7,124,964 | B2 | 10/2006 | Bui | |
| 2006/0049273 | A1 | 3/2006 | Zhang | |
| 2006/0113400 | A1 | 6/2006 | Dodson | |

FOREIGN PATENT DOCUMENTS

| | | | |
|---|---|---|---|
| EP | 00835162 | B1 | 4/1998 |
| WO | WO9701392 | A1 | 1/1997 |
| WO | 03084668 | A2 | 10/2003 |
| WO | WO2009043092 | A1 | 4/2009 |

* cited by examiner

FLAT JET WATER NOZZLES WITH ADJUSTABLE DROPLET SIZE INCLUDING FIXED OR VARIABLE SPRAY ANGLE

CROSS-REFERENCE TO RELATED APPLICATIONS

This utility application is a U.S. nationalization and claims benefit and priority of international patent application number PCT/US2009/005345, filed Sep. 25, 2009, which in turn claims benefit and priority of the filing of Australian Provisional Patent Application No. 2008904999 filed on Sep. 25, 2008, titled "PLUMES", the contents of all of which are hereby incorporated by reference, for all purposes, as if fully set forth herein.

BACKGROUND OF THE INVENTION

1. Field of the Invention

The present invention relates generally to fluid spray nozzles. More particularly, this invention relates to flat jet fluid nozzles with adjustable droplet size including fixed or variable spray angle embodiments.

2. Description of Related Art

Nozzles for converting fluids, such as water, under pressure into atomized mists, or plumes of vapor, are well known in the art. Nozzles find use in many applications, for example, irrigation, landscape watering, fire-fighting, and even solvent and paint spraying. Nozzles are also used in snowmaking equipment to provide atomized mists of water droplets of a size suitable for projection through a cold atmosphere to be frozen into snow for artificial snowmaking at ski resorts. Conventional nozzles are known to provide fluid mist jets of a particular shape of spray pattern, for example conical mist spray patterns. Nozzles which provide a flat jet (fan shaped) have proved particularly useful with regard to snowmaking, fire-fighting and irrigation.

One difficulty with conventional fluid nozzles, particularly those associated with snowmaking is the challenge of converting large volumes of water into small droplets or particles suitable for freezing in the atmosphere. The conventional approach has typically been to increase the number of small output, fixed orifice and spray angle nozzles had to be used. In this approach, the only way one could vary the output (fluid flow rate) for a fixed fluid input pressure was to have the nozzles arranged into banks which could be selectively turned on or off. Some snowmaking fan guns have up to 400 fixed nozzles arranged into 4 separate banks for this purpose. Alternatively, to vary fluid flow rate one could vary the operating pressure of the input fluid. However, it is known that by varying the fluid input pressure, the droplet size will also vary.

In yet another conventional approach to achieve greater volume of water through a single fixed nozzle, one can simply use a larger fixed orifice nozzle with results in larger droplets. Conventional fire-fighting nozzles are known to have an increase in droplet size and water flow rate increases.

Another problem with conventional small, fixed orifice jet nozzles used in snowmaking is that they do not have much projection due to short fluid trajectories within the nozzle, small particle size, and the fluid stream may be broken down into individual streams thereby increasing internal friction losses.

There is a need for flat jet fluid nozzles with adjustable droplet size. It would also be useful to have nozzles that provide fixed and adjustable spray angles in addition to adjustable droplet size. Such nozzles may provide the user greater control over the following nozzle spray variables: fluid flow rate, droplet size formed at ejection orifice, spray pattern and spray angle.

SUMMARY OF THE INVENTION

An embodiment of a flat jet fluid nozzle is disclosed. The nozzle may include a lower nozzle plate including a lower impingement surface formed therein, at least one fluid intake port disposed at an inner end of the lower impingement surface and a lower orifice edge disposed along an outer end of the lower impingement surface. The nozzle may further include an upper nozzle plate including an upper impingement surface formed therein and an upper orifice edge disposed along an outer end of the upper impingement surface. The nozzle may further include a seal configured for sealing the lower nozzle plate to the upper nozzle plate, such that the lower and upper impingement surfaces are opposed toward one another, thereby forming a fluid channel between the impingement surfaces, the fluid channel configured to direct pressurized fluid from the at least one fluid intake port to a slotted orifice formed between the opposed lower and upper orifice edges. The nozzle may further include a droplet size adjustment mechanism configured for attachment to the upper and lower nozzle plates for selectively controlling fluid droplet size ejected from the slotted orifice.

Another embodiment of a flat jet fluid nozzle is disclosed. The nozzle may include opposed lower and upper nozzle plates having a plurality of fluid intake ports leading to a plurality of fluid chambers. Each of the plurality of fluid chambers may include opposed impingement surfaces having first and second regions for accelerating fluid flow along the opposed impingement surfaces and causing opposed streams of fluid to exit opposed orifice edges and impinge upon one another. The nozzle may further include the distance between opposed orifice edges being selectively adjustable.

Additional features and usefulness of the invention will be set forth in the description which follows, and in part will be apparent from the description, or may be learned by the practice of the present invention.

BRIEF DESCRIPTION OF THE DRAWINGS

The following drawings illustrate exemplary embodiments for practicing the invention. Like reference numerals refer to like parts in different views or embodiments of the present invention in the drawings.

DETAILED DESCRIPTION

Embodiments of flat jet fluid nozzles and their component parts are disclosed herein. Various nozzle embodiments provide for adjustable droplet or particle size, according to the present invention. Variable droplet size may be particularly useful in the context of snowmaking where smaller particles of water, or droplets, may freeze faster when forming particles of ice or snow in a cold atmosphere when frozen relative to larger droplets of water. Various other nozzle embodiments provide for fixed or adjustable spray angle. Many conventional flat jet nozzles only provide a fixed spray angle. Still other embodiments provide for multiple fluid intake ports providing greater control over fluid flow rate. Embodiments of flat jet fluid nozzles described herein are individually capable of water flow rates up to approximately 200 gallons/minute and projecting droplets up to about 20 meters through the atmosphere.

It will be understood, however, that the flat jet fluid nozzles shown and described herein may be used with any suitable fluid, not just water. For example, and not by way of limitation, the fluid may be a fuel, solvent, paint, oil or any other fluid that may be atomized according to the teachings of the present invention. A useful feature of the various nozzle embodiments disclosed herein is that they do not require any compressed air to achieve atomization of the fluid. The atomization is achieved using only the structure of the various nozzle embodiments and fluid pressure applied to the one or more fluid intake ports.

Figure 1:
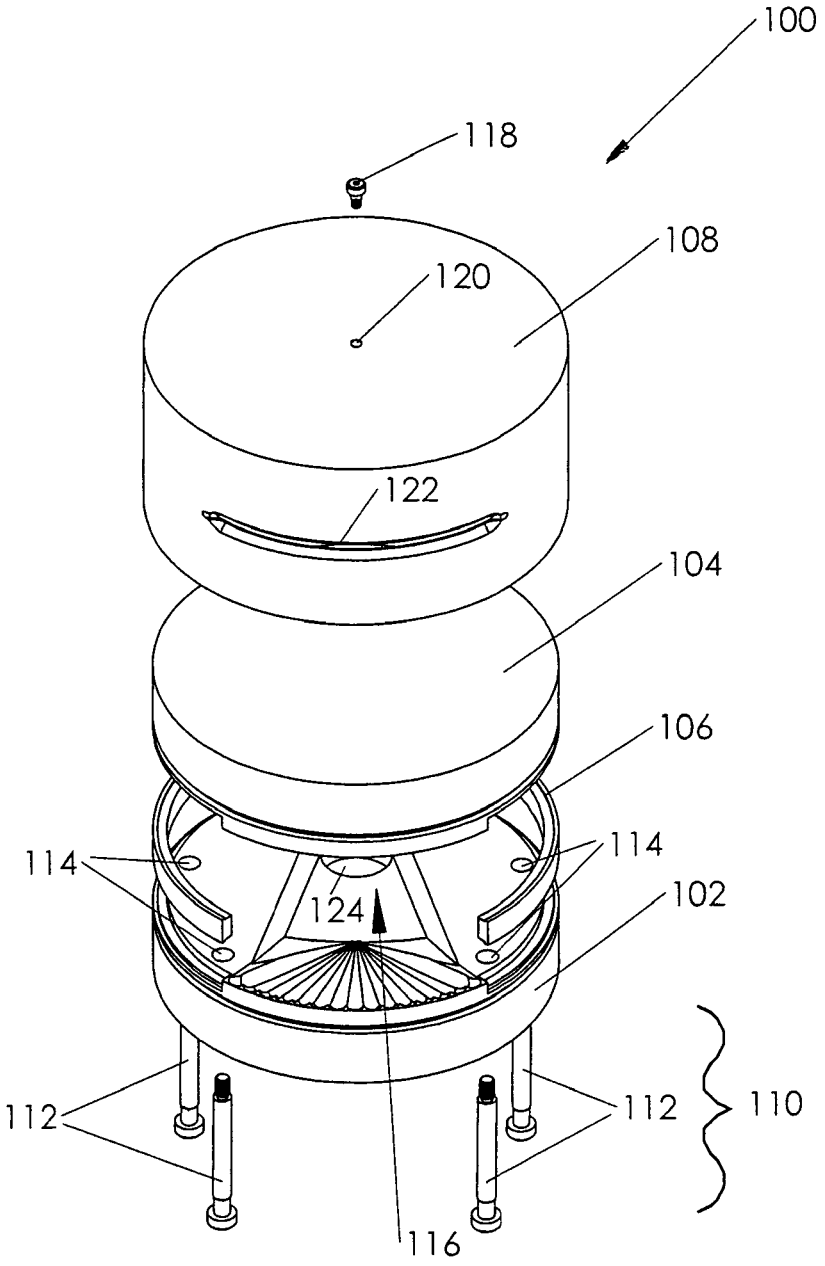
FIGS. 1-3 are top-front perspective, front and bottom-front perspective exploded views, respectively, of an embodiment of flat jet fluid nozzle, according to the present invention.
Figure 2:
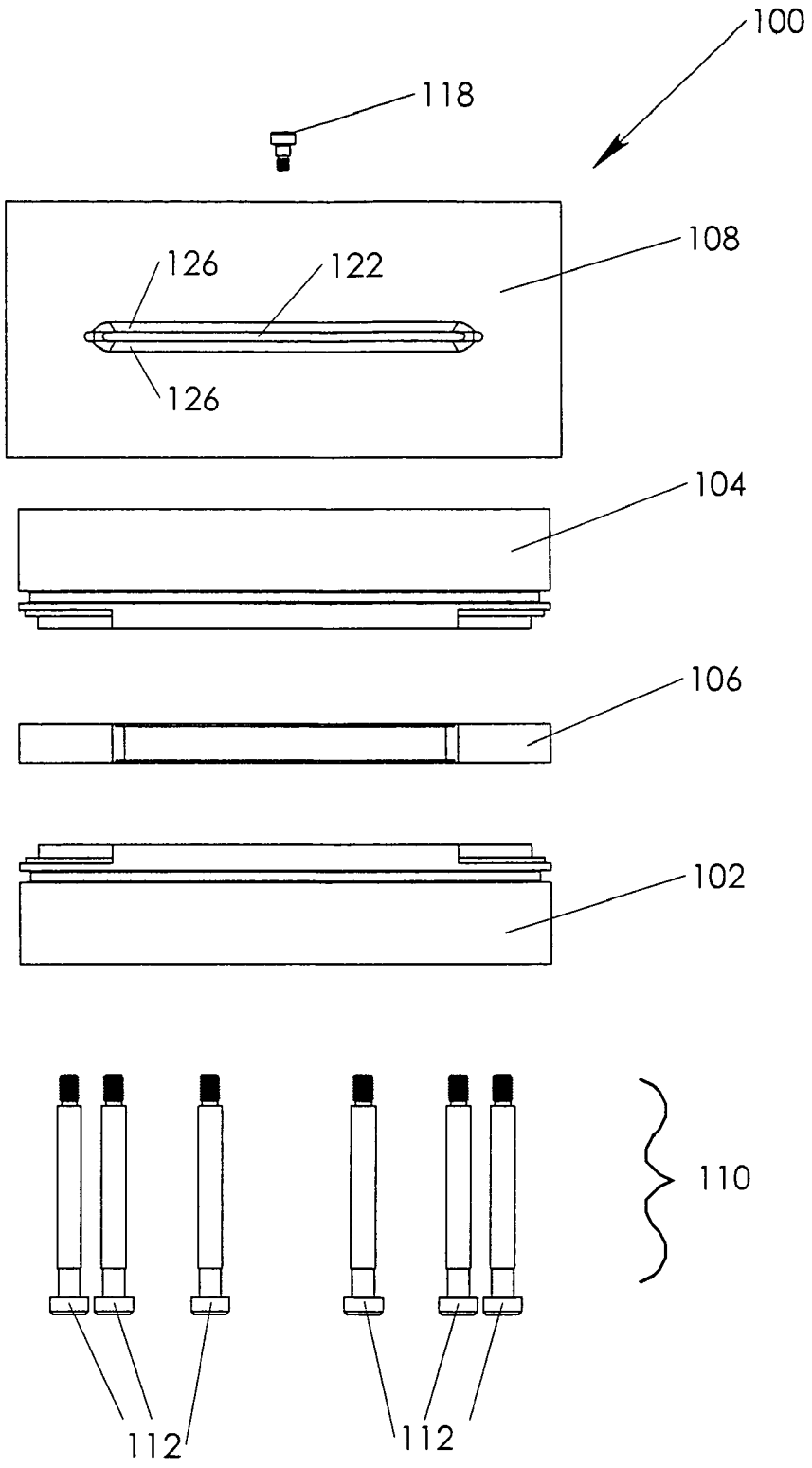
Figure 3:
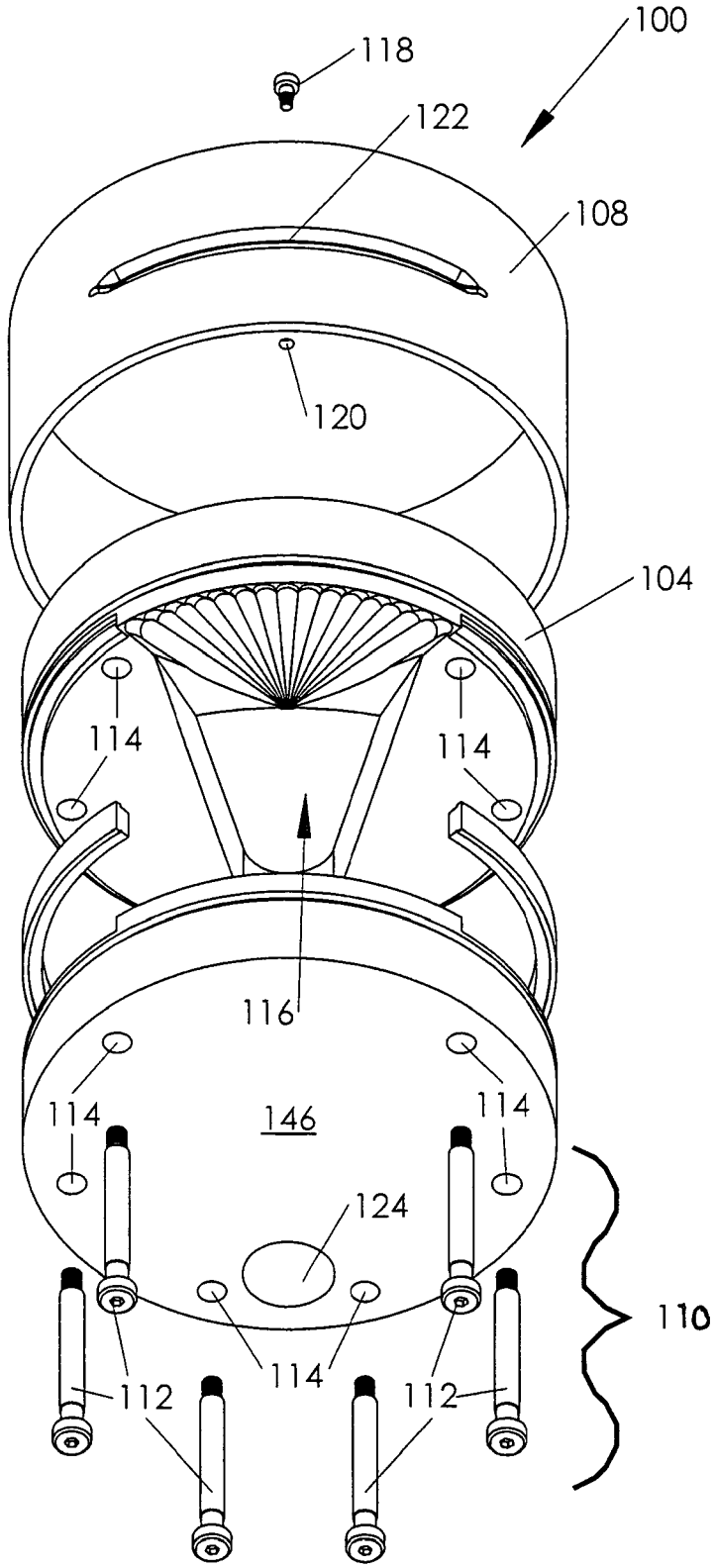

FIGS. 1-3 are top-front perspective, front and bottom-front perspective exploded views, respectively, of an embodiment of flat jet fluid nozzle 100, according to the present invention. Nozzle 100 may include a lower nozzle plate 102, an upper nozzle plate 104, a seal 106, an optional cover 108 and a droplet size adjustment mechanism 110. As shown in FIGS. 1-3, the illustrated droplet size adjustment mechanism 110 may be a plurality of bolts 112 used with corresponding bolt holes 114 for securing the seal 106 between the lower nozzle plate 102 and the upper nozzle plate 104. Bolt holes 114 may pass completely through one of the plates 102 (shown) or 104. The bolt holes 114 in the other plate 104 (shown) or 102 may have threads within the bolt hole 114 to mesh with the threads of the bolts 112. Alternatively, the bolt holes 114 may pass completely through both plates 102 and 104 and be secured using suitable nuts and/or washers (neither shown) to mate with the threading of the bolts 112.

It will be understood that there may be many other schemes for adjusting the droplet size that would be a suitable replacement for the droplet size adjustment mechanism 110 described and shown herein. For example and not by way of limitation, a clamping mechanism mounted externally to plates 102 and 104 might be used to selectively compress seal 106 in between plates 102 and 104, according to an alternative embodiment of the present invention. In yet another embodiment, selectively adjustable opposed orifice edges could be incorporated into one or both of the plates 102 and 104 to allow for a set screw or other mechanical mechanism to adjust the spacing of slotted orifice 136 and, thus, droplet or particle size, according to the present invention.

Seal 106 may be used to separate the lower nozzle plate 102 and the upper nozzle plate 104. Seal 106 may also be used to form a fluid-tight seal around a fluid channel 116 formed between the lower nozzle plate 102 and the upper nozzle plate 104. Seal 106 may be formed of any suitable elastically deformable material that can form a fluid-tight seal between the lower nozzle plate 102 and the upper nozzle plate 104. For example and not by way of limitation, seal 106 may be formed of a rubber material or an elastomer, i.e., any one of various polymers known to those of ordinary skill in the art, having elastic properties resembling those of natural rubber.

The optional cover 108 may be secured to the upper nozzle plate 104 by a screw 118 and hole 120 for screwing into a threaded hole in the top of the upper nozzle plate 104 or by some other attachment mechanism (not shown) such as a bayonet mount, clips, threaded engagement, interference fit or any other suitable means known to those of ordinary skill in the art. The optional cover 108 may further include an opening 122. The opening 122 may have a bevel 126 (best seen in FIG. 2) surrounding the opening 122 for widening the path to atmosphere of fluid droplets being ejected from the fluid channel 116.

Lower nozzle plate 102 may include one or more fluid intake ports 124 (one shown in FIGS. 1 and 3). Fluid intake port 124 may be configured for connection (by threading, quick connection or other means) to a high-pressure fluid source, for example and not by way of limitation, a water pipe, that provides the fluid which is to be atomized by the nozzle 100.

Figure 4:
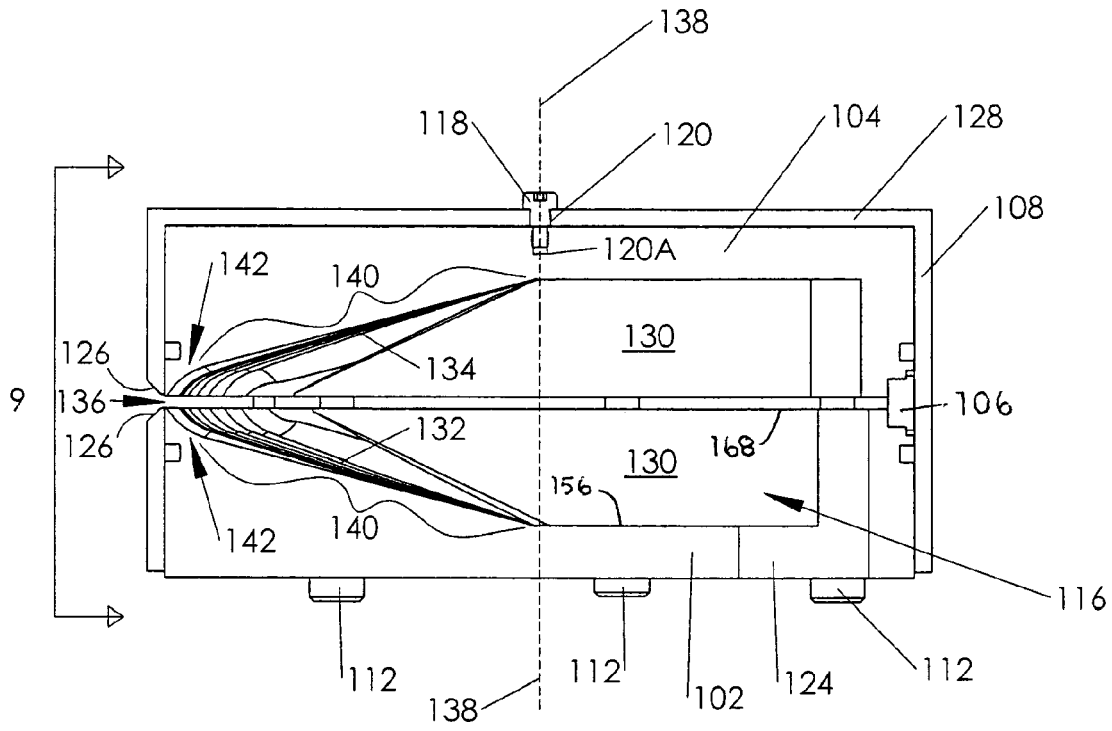
FIG. 4 is a cross-sectional right-side view of the embodiment of an assembled flat jet fluid nozzle shown in FIGS. 1-3, according to the present invention.

FIG. 4 is a cross-sectional right-side view of the embodiment of an assembled flat jet fluid nozzle 100 shown in FIGS. 1-3, according to the present invention. As shown in FIG. 4, the lower nozzle plate 102 and upper nozzle plate 104 are separated by seal 106 and held in place by bolts 112. Seal 106 may be a compressible, or elastically deformable, material, for example and not by way of limitation, an elastomer or rubber material. Seal 106 surrounds the fluid channel 116 when viewed from the top and is located between the lower nozzle plate 102 and upper nozzle plate 104. As further shown in FIG. 4, optional cover 108 may surround the lower nozzle plate 102 and upper nozzle plate 104. Cover 108 may be secured by screw 118 to hole 120A formed in the top 128 of upper nozzle plate 104. Screw 118 may be used to rotationally adjust and secure the cover 108 and its opening 122 relative to the slotted orifice 136 to adjust spray angle as further described below.

FIG. 4 further illustrates the vertical cross-section of fluid channel 116 beginning with a fluid intake port 124 leading to a fluid chamber 130 which gathers and redirects fluid toward opposed lower and upper impingement surfaces 132 and 134. The fluid is eventually directed to a slotted orifice 136, where laminar fluid passing across opposed impingement surfaces 132 and 134 collide under pressure and immediately atomize upon contact and are ejected out of the slotted orifice 136 in a flat jet spray pattern.

As shown in the vertical cross-section of FIG. 4, the embodiment of nozzle 100 includes a fluid chamber 130 which initially provides no narrowing in the vertical dimension of the fluid channel 116, i.e., from the fluid intake port 124 until it meets with the opposed impingement surfaces 132 and 134 at the central axis, shown in dashed line at 138. Described another way, floor 156 and roof 168 are generally parallel to one another.

However, the opposed impingement surfaces 132 and 134 provide a gradual narrowing of the height of the fluid channel 116 as they radiate from the central axis 138. The gradual narrowing may reflect a steady gradient in a linear first region, shown generally at brackets 140 in FIG. 4. The narrowing of the opposed impingement surfaces 132 and 134 of nozzle 100 in the first region 140 accelerates the fluid flow radially and toward the slotted orifice 136.

In a nonlinear second region, shown generally at arrows 142, the opposed impingement surfaces 132 and 134 of nozzle 100 provide increased narrowing in the vertical dimension of the fluid channel 116. The increased narrowing in the nonlinear second region 142 may reflect a variable gradient relative to the gradient in the first region 140. The increased narrowing in the second region 142 further accelerates the fluid flow toward the slotted orifice 136. The second region 142 further causes fluid from opposed directions (impingement surfaces 132 and 134) to impinge upon each other and thereby atomize at the slotted orifice 136. The accelerated atomized fluid droplets are then ejected into the atmosphere.

Figure 5:
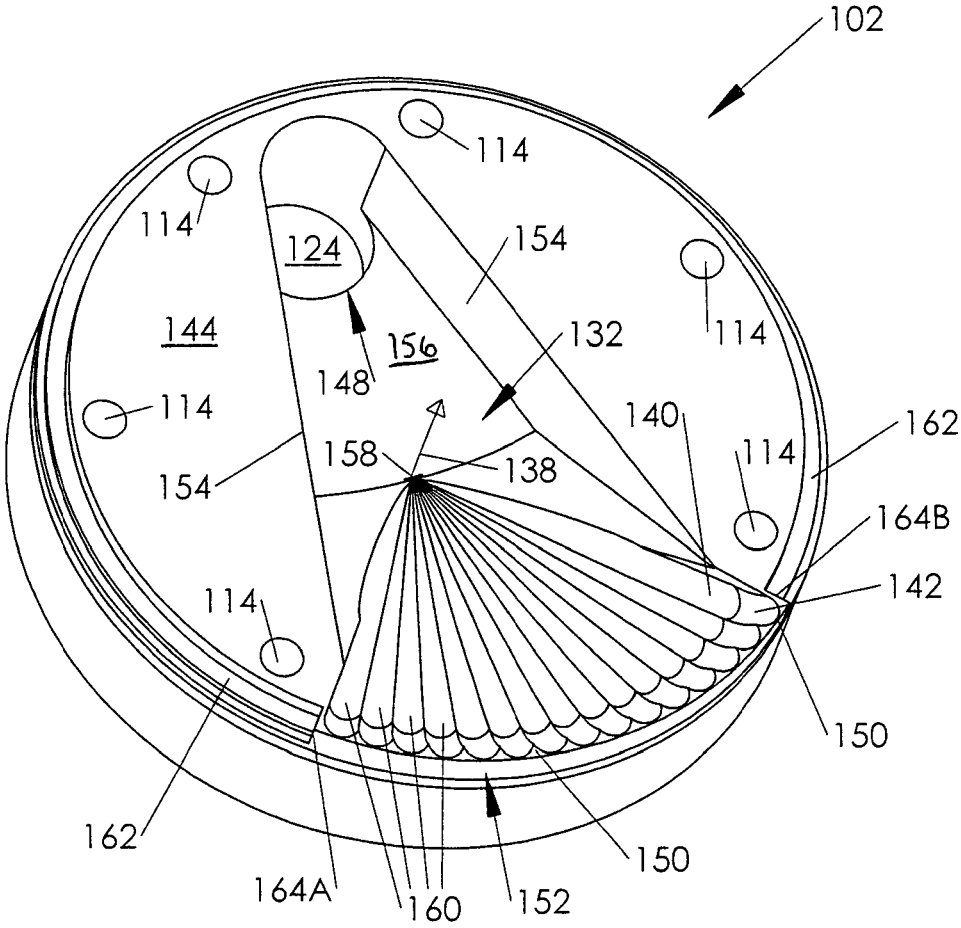
FIGS. 5 and 6 are perspective and top views, respectively of an embodiment of a lower nozzle plate, according to the present invention.
Figure 6:
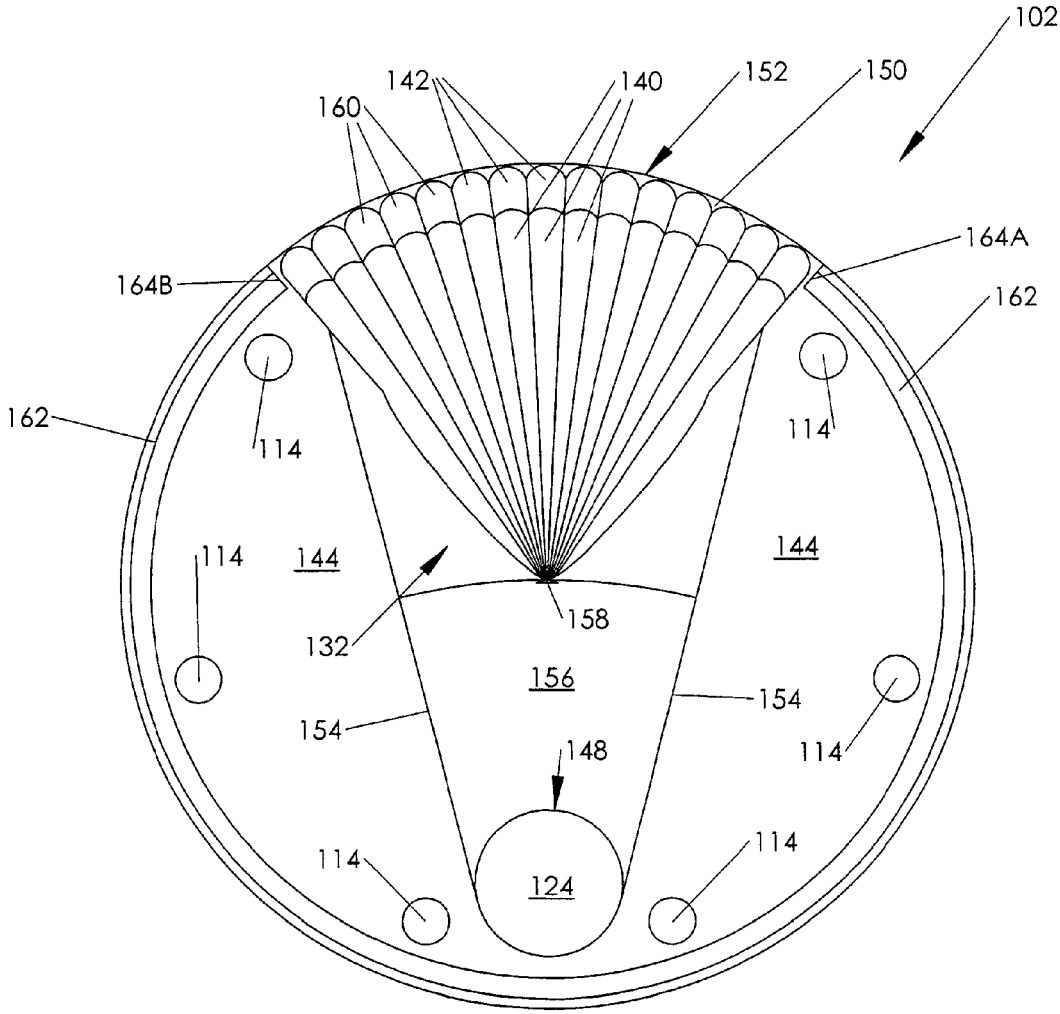

FIGS. 5 and 6 are perspective and top views, respectively of an embodiment of a lower nozzle plate 102, according to the present invention. Lower nozzle plate 102 may include a lower impingement surface 132 formed into a top surface 144 of plate 102. Lower nozzle plate 102 may include a fluid intake port 124 passing through a bottom surface (not shown in FIGS. 5-6, but see 146 in FIG. 3) of plate 102. The fluid intake port 124 may be disposed at an inner edge 148 adjacent to floor 156. The lower nozzle plate 102 may further include a lower orifice edge 150 disposed along an outer cylindrical surface 152 of the lower nozzle plate 102. A portion of fluid chamber 130 is bounded by lower sidewalls 154 which rise vertically from generally flat floor 156 of lower nozzle plate 102. Lower sidewalls 154 may include planar surfaces and extend radially from the fluid intake port 124 toward lower orifice edge 150.

FIGS. 5 and 6 further illustrate bolt holes 114 (six shown) formed in top surface 144 that are used with bolts 112 (FIG. 1) to secure lower nozzle plate 102 to upper nozzle plate 104 (FIG. 1) with a seal 106 in between. The number of bolt holes 114 may be varied above or below the six shown, according to other embodiments. There only needs to be enough bolts 112 to secure the seal 106 (FIG. 1) between the lower nozzle plate 102 and the upper nozzle plate 104 (FIG. 1). Lower nozzle plate 102 may further include a seal seat 162 for receiving the seal 106 (FIG. 1). Seal seat 162 (and seal 106, FIG. 1) are configured to extend around the periphery of the top surface 144 of lower nozzle plate 102 from opposing ends 164A and 1646 of slotted orifice 136 (FIG. 4).

FIGS. 5 and 6 further illustrate a plurality of radial flutes 160 (fifteen flutes shown in FIGS. 5 and 6) each beginning from point 158 where the central axis 138 intersects with floor 156 and extending up a steady linear gradient in the first region 140, then more sharply up the nonlinear gradient of the second region 142 adjacent to the lower orifice edge 150. While radial flutes 160 shown in FIGS. 5 and 6 are generally of a rounded profile in cross-section, V-shaped and other polygonal or curved profiles may be suitable for alternative embodiments of lower nozzle plate 102 consistent with the teachings of the present invention. It will also be understood that in yet another embodiment, nozzle plates (upper and lower) may have no fluting at all. According to these embodiments, the nozzle plates may simply include smooth frusto-conical impingement surfaces (see, e.g., FIGS. 17-19 and related discussion below).

Figure 7:
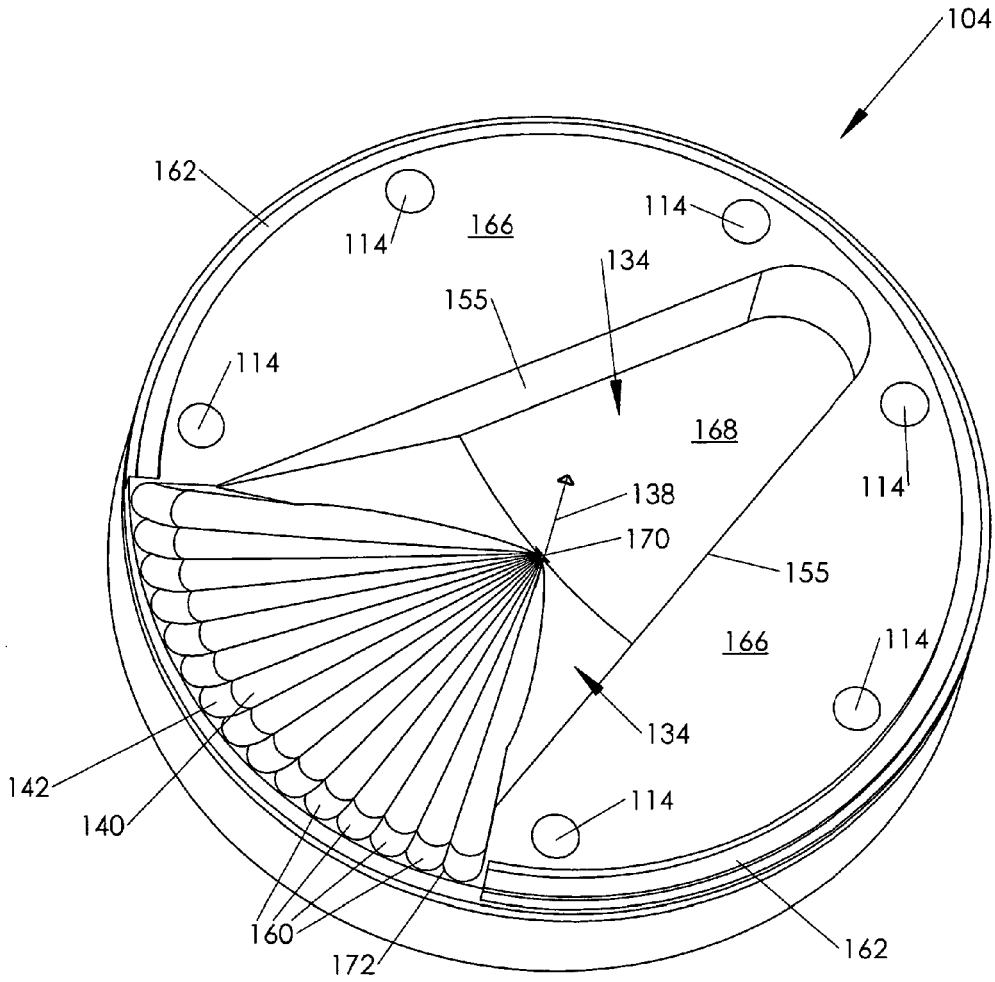
FIG. 7 is a bottom perspective view of an embodiment of an upper nozzle plate, according to the present invention.

FIG. 7 is a bottom perspective view of an embodiment of an upper nozzle plate 104, according to the present invention. As is evident when compared to lower nozzle plate 102 (FIGS. 5 and 6), an upper nozzle plate 104 has basically all of the same corresponding features of the lower nozzle plate 102 except for the fluid intake port 124. Specifically, an upper nozzle plate 104 may include a bottom surface 166 having an upper impingement surface 138, roof 168, bolt holes 114, and seal seat 162 formed therein. Like its counterpart and opposed lower impingement surface 132, the upper impingement surface 134 includes a plurality of radial flutes 160 beginning at point 170 on central axis 138 at roof 168 and extending through a linear first region 140 to a nonlinear second region 142 and finally to upper orifice edge 172 forming half of slotted orifice 136 (FIG. 4). Similarly, another portion of fluid chamber 130 is bounded by upper sidewalls 155 which descend vertically from generally flat roof 168 of upper nozzle plate 104.

Figure 8:
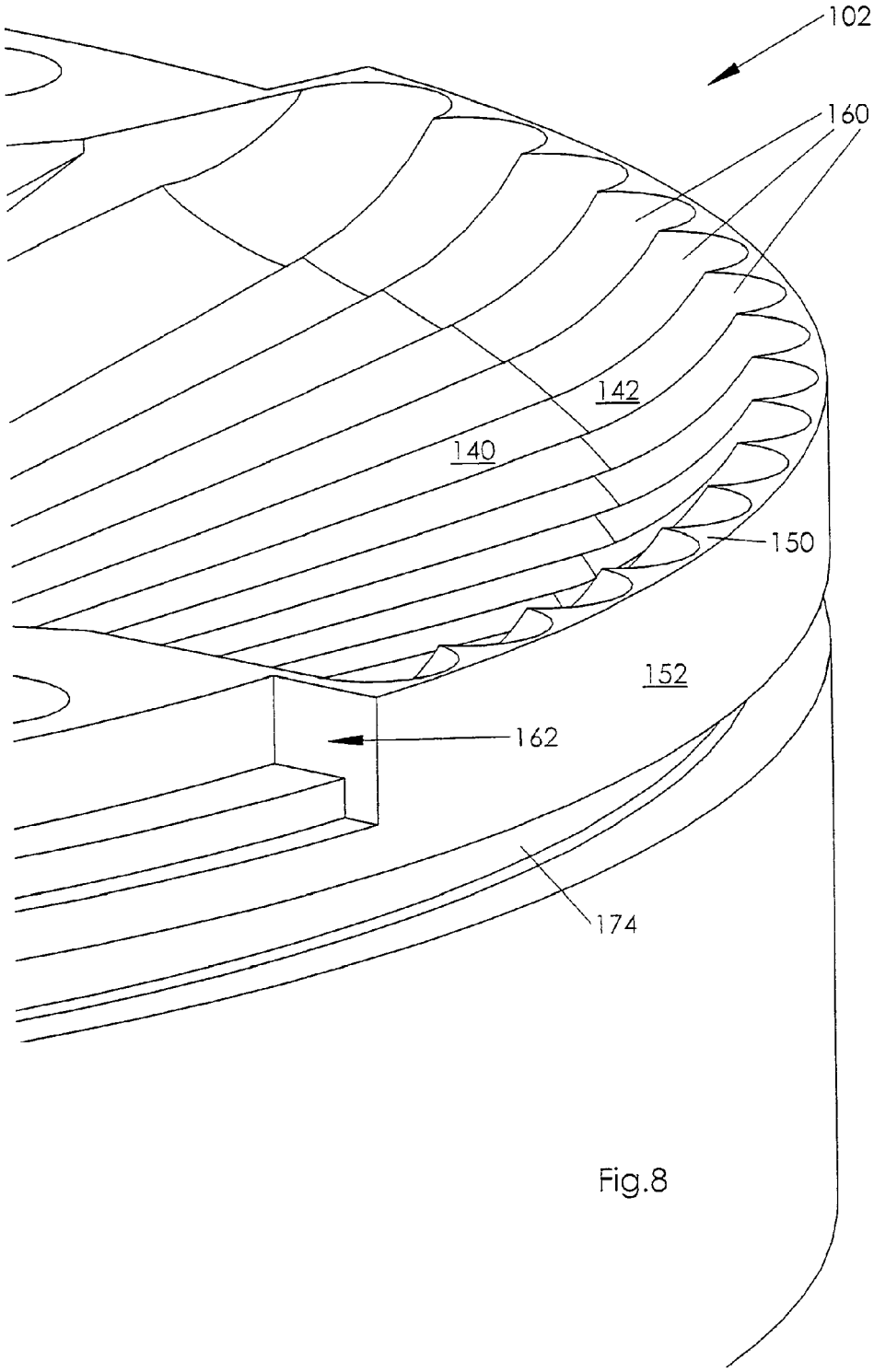
FIG. 8 is a magnified perspective view of an embodiment of a lower orifice edge, according to the present invention.

FIG. 8 is a magnified right-side perspective view of a portion of a lower nozzle plate illustrating an embodiment of an unchamfered lower orifice edge 150, according to the present invention. The 3-dimensional sculpting of radial flutes 160 is shown, as well as additional detail of seal seat 162. An auxiliary seal seat 174 is also shown around the outer cylindrical surface 152, which may be used for further sealing with another seal (not shown).

Figure 9:
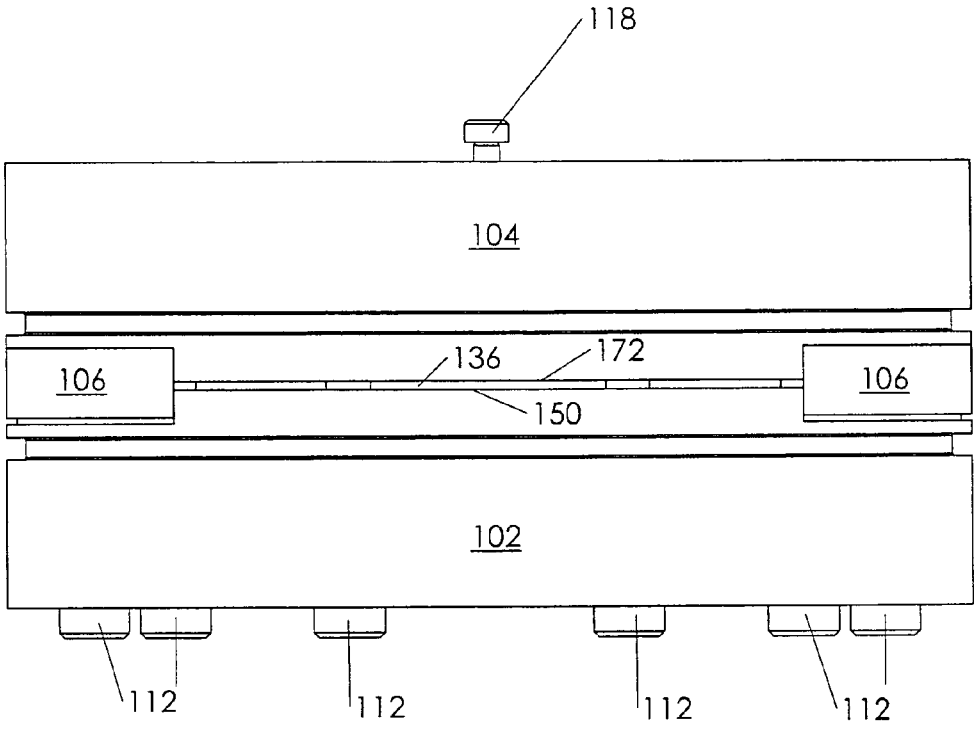
FIG. 9 is a front view of the embodiment of a flat jet fluid nozzle shown in FIGS. 1-4 assembled without the optional cover, according to the present invention.

FIG. 9 is front view of the embodiment of the flat jet fluid nozzle 100 shown in FIGS. 1-4, assembled without optional cover 108, according to the present invention. FIG. 9 illustrates seal 106 in between lower and upper nozzle plates 102 and 104 as secured by bolts 112. As further shown in FIG. 9, slotted orifice 136 is defined by lower and upper orifice edges 150 and 172.

The spray pattern that exits each vertically aligned flute 160 pair at the slotted orifice 136 is a mini flat jet fan with long axis oriented in the vertical direction. Of course, there are a plurality (fifteen in the illustrated embodiment) of such vertically aligned flute pairs each directing a flat jet in a different angular direction when referenced horizontally. The embodiment of nozzle 100 shown in FIGS. 1-9, can achieve an initial spray angle as wide as about 80° at the slotted orifice 136 and may include up to fifteen vertically oriented flat jet fans spread evenly through the horizontally oriented 80° initial spray angle. However, it will be understood that many other embodiments may have greater or fewer pairs of flutes 160 forming mini flat jets, depending on the chosen width of each flute at the slotted orifice 136 for a given nozzle angular configuration (80° shown). It will also be understood that greater or fewer pairs of flutes 160 may be achieved by varying the shown nozzle angular configuration, which is approximately 80°. Embodiments of nozzle 100 have been tested to deliver up to approximately 200 gallons/minute under sufficient water pressure.

The approximately 80° initial spray angle achieved at the slotted orifice 136 is maintained with the optional cover 108 rotationally oriented so that opening 122 aligns perfectly with slotted orifice 136. Of course, if a smaller spray angle is desired, the optional cover plate 108 may be rotationally oriented such that it masks a portion of slotted orifice 136 thereby preventing the atomized fluid to freely exit slotted orifice 136. The rotational alignment of optional cover 108 may be fixed by screw 118 according to one embodiment, or by holes and screws (not shown) formed along the outer cylindrical surface of cover 108 and the plates 102 and 104, according to another embodiment. It is also possible to rotate the nozzle assembly relative to a fixed shell having an opening, to mask the flat jet and thereby adjust spray angle as discussed below with reference to FIG. 10.

Figure 10:
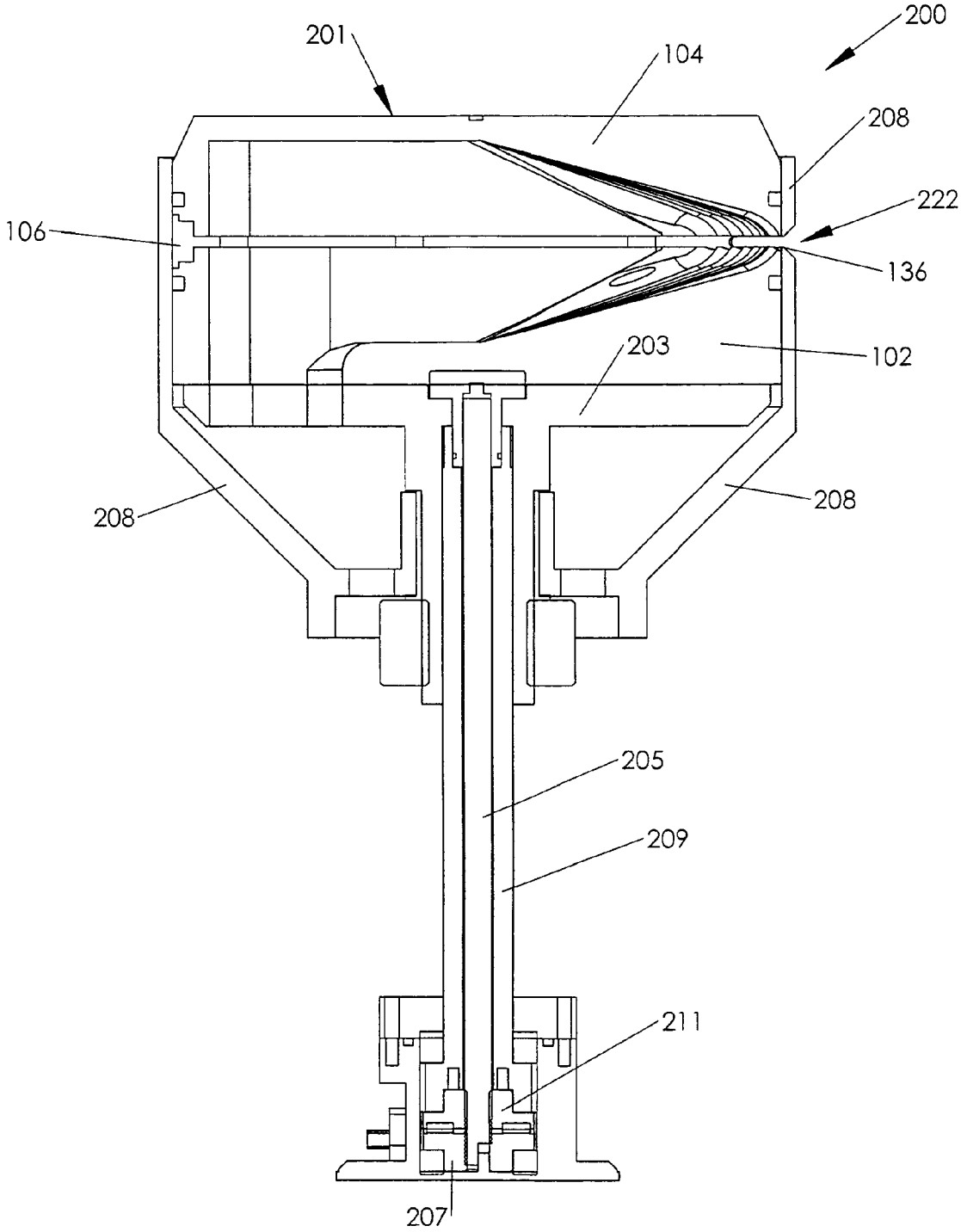
FIG. 10 illustrates another embodiment of a flat jet fluid nozzle having a fixed shell within which a nozzle assembly is selectively rotated to adjust spray angle, according to the present invention.

FIG. 10 illustrates another embodiment of a flat jet fluid nozzle 200 having a fixed shell 208 within which a nozzle assembly 201 is selectively rotated to adjust spray angle, according to the present invention. According to nozzle 200, fixed shell 208 surrounds a nozzle assembly 201 consisting of an upper nozzle plate 104 and lower nozzle plate 102, separated by seal 106. The nozzle assembly 201 forms a slotted orifice 136 in the same manner as nozzle 100. The base plate 203 and lower nozzle plate 102 are attached to a screw jack shaft 205 that moves up and down under control of a screw jack shaft worm gear 207. The lower nozzle plate 102 moves up and down on shoulder screws (not shown for clarity). The shoulder screws are set into the base plate 203 and are passed through the lower nozzle plate 102 and into the upper nozzle plate 104, which is fixed vertically. This mechanical feature allows movement of the lower nozzle plate 102, thereby allowing the distance separating lower and upper orifice edges 150 and 172 of slotted orifice 136 to be adjusted by a motor rather than by manually adjusting bolts 112 (FIG. 1). Hence, an embodiment of an automated mechanism for adjusting droplet size on nozzle 200 has been disclosed with reference to FIG. 10 and related discussion.

Furthermore, FIG. 10 illustrates a rotation shaft 209 also connected to base plate 203 that rotates the nozzle assembly 201 under control of a rotation worm gear 211. Thus, the spray angle may be decreased from about 80° to any smaller spray angle by rotating the slotted orifice 136 relative to an opening 222 in fixed shell 208. Hence, an embodiment of an automated mechanism for adjusting spray angle on nozzle 200 has been disclosed with reference to FIG. 10 and related discussion. Other methods for selectively orienting an opening 122 (FIG. 1), or 222 (FIG. 10) relative to the slotted orifice 136 (manually or automatically) will be readily apparent to one of ordinary skill in the art. Such alternative embodiments are considered to be within the scope of the present invention, literally, or under the doctrine of equivalents.

Figure 11:
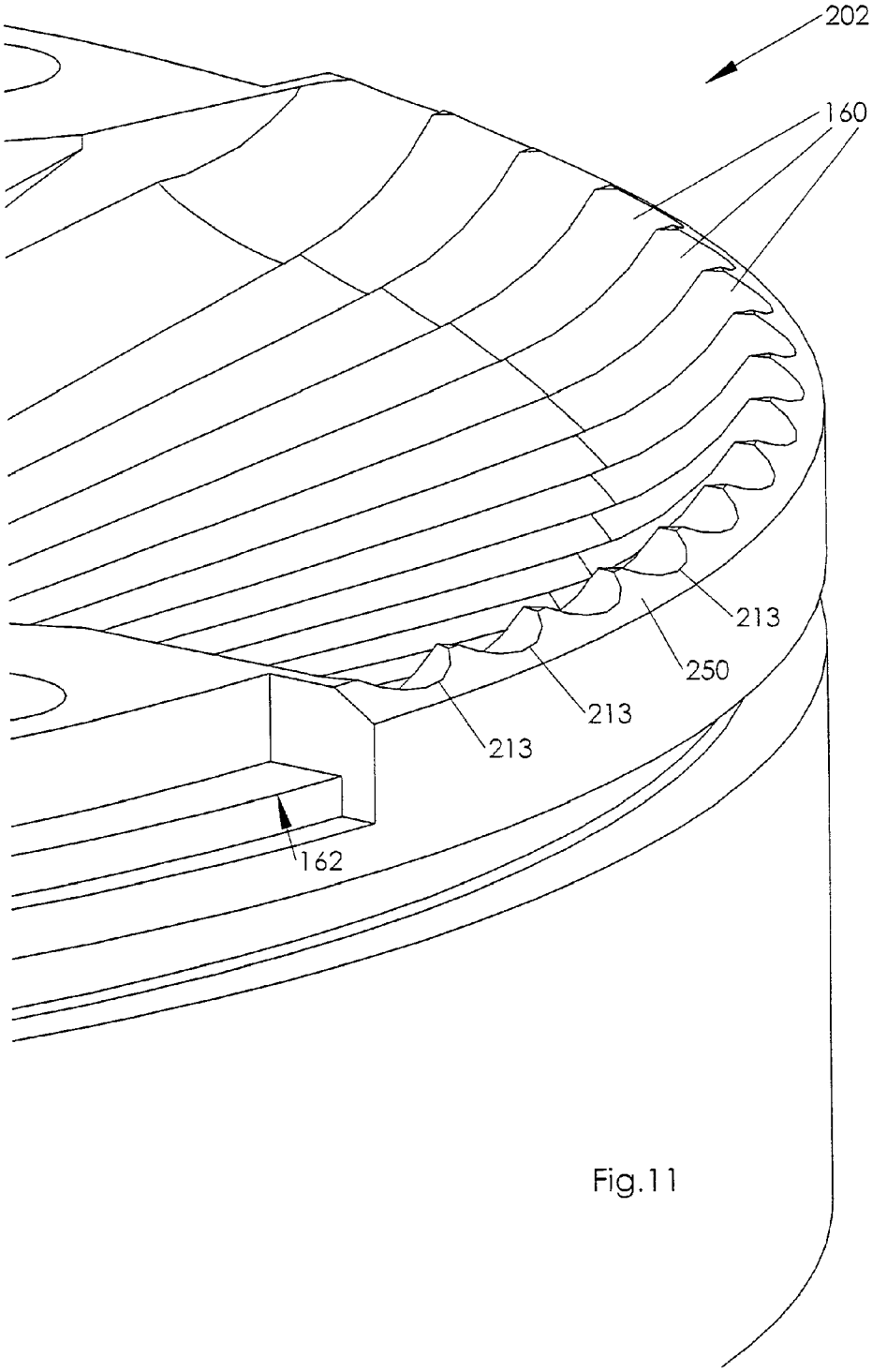
FIG. 11 is a magnified perspective view of another embodiment of a lower nozzle plate having a chamfered lower orifice edge, according to the present invention.

FIG. 11 is a magnified perspective view of another embodiment of a lower nozzle plate 202 having a chamfered lower orifice edge 250, according to the present invention. All other aspects of lower nozzle plate 202 may be identical to those described above for lower nozzle plate 102. It will be understood that a similar chamfered upper orifice edge 272 (FIG. 12) may be applied to another embodiment of an upper nozzle plate 204 (FIG. 12).

Figure 12:
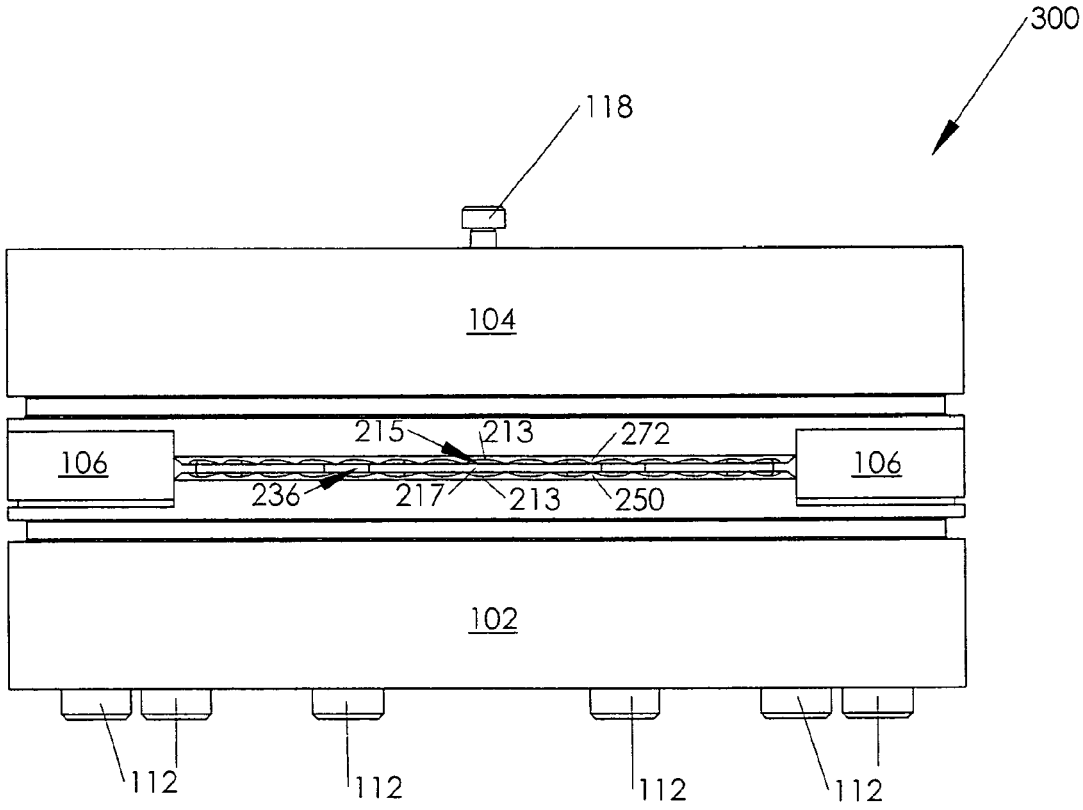
FIG. 12 is front view of an embodiment of a flat jet fluid nozzle having chamfered nozzle plates assembled without a cover, according to the present invention.

FIG. 12 is front view of an embodiment of a flat jet fluid nozzle 300 having chamfered nozzle plates 250 and 272 assembled without an optional cover 108, according to the present invention. The chamfered lower orifice edge 250 exposes rounded flute edges 213 useful for forming the bottom half of mini flat jet nozzles, shown generally at arrow 215 within the slotted and chamfered orifice edge 236. Each mini flat jet nozzle 215 includes a pair of vertically aligned and opposed rounded flute edges 213 surrounding a horizontal slot 217 as formed in the slotted and chamfered orifice edge 236.

Each mini flat jet nozzle 215 forms a horizontally oriented flat fan spray pattern. The plurality (fifteen mini flat jet nozzles 215) of horizontally radiating individual spray patterns of nozzle 300 combine to form a highly atomized flat jet fan spray pattern that is distinct from the spray pattern of nozzle 100.

In addition to chamfering an orifice edge, various other features of the basic is flat jet nozzles 100, 200 and 300 described above may be modified or rearranged to achieve specific results consistent with the principles of the present invention. For example, the shape of the fluid channel may also be modified to achieve a convergence and divergence early in the fluid chamber.

Figure 13:
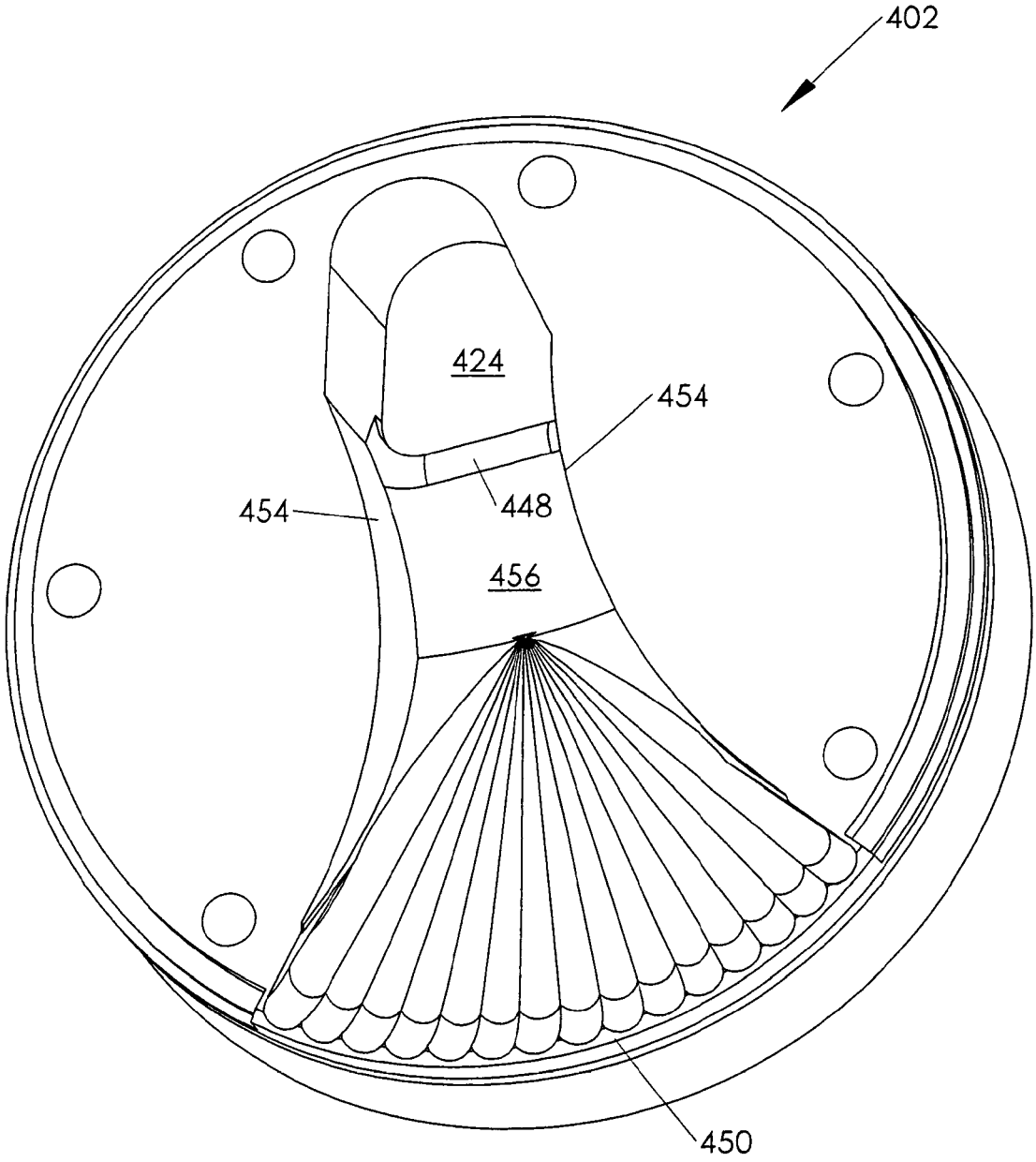
FIGS. 13 and 14 are perspective views of alternative embodiments of lower and upper nozzle plates, according to the present invention.
Figure 14:
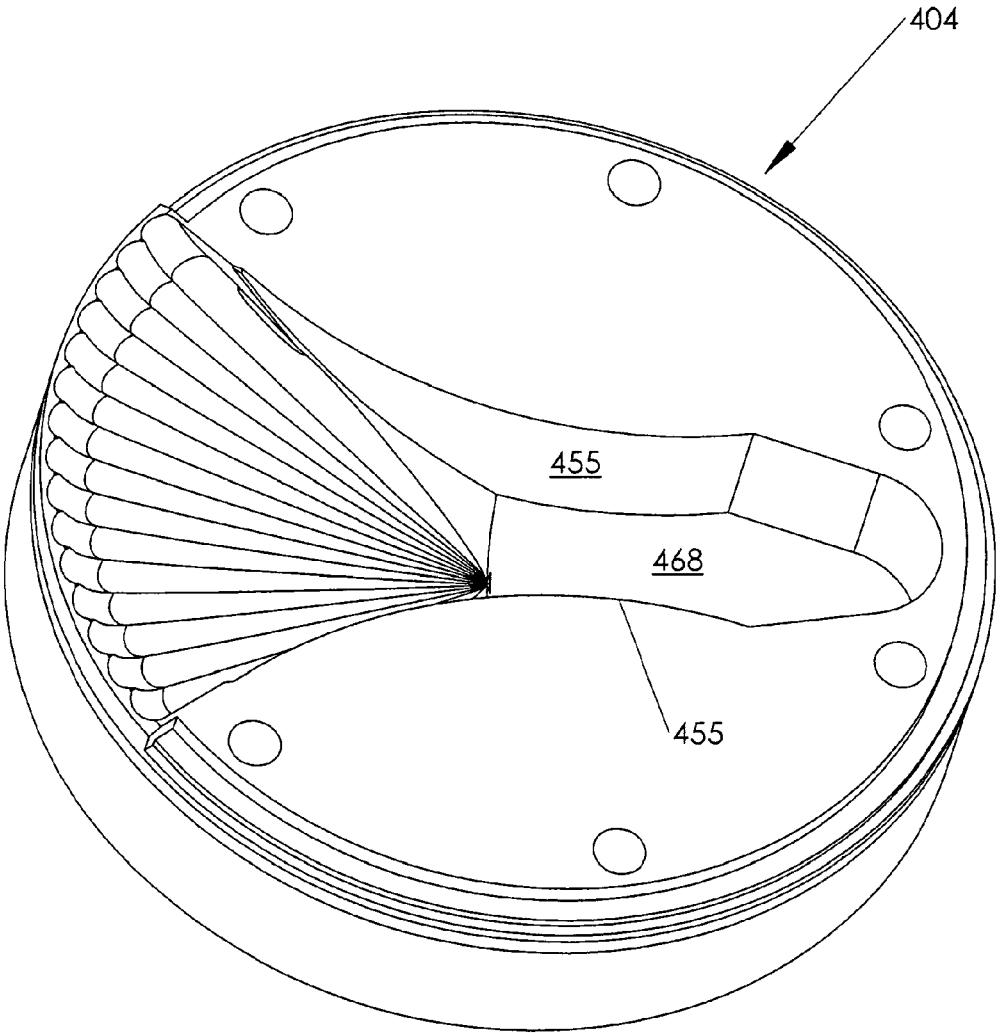
Figure 15:
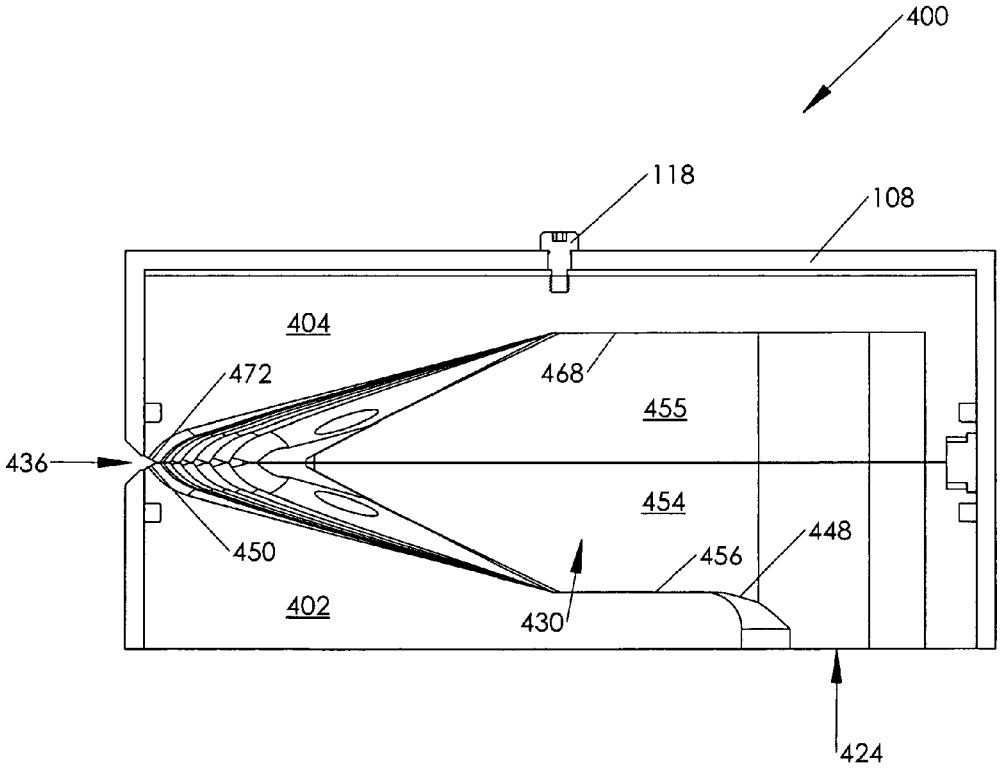
FIG. 15 illustrates a cross-sectional view of an embodiment of a flat jet fluid nozzle including the alternative embodiments of lower and upper nozzle plates shown in FIGS. 13 and 14.

FIGS. 13 and 14 are perspective views of alternative embodiments of lower and upper nozzle plates 402 and 404 each having respective convergent/divergent lower and upper sidewalls 454 and 455, according to the present invention. The convergent/divergent sidewalls 454 and 455 improve acceleration of fluid from the intake port 424 toward slotted orifice 436 (FIG. 15). As shown in FIG. 13, the shape of fluid intake port 424 may also be modified to include a rounded inner edge 448 adjacent floor 456. The rounded inner edge provides smoother, laminar fluid flow relative to the abrupt inner edge 148 (FIGS. 5 and 6) of nozzle 100. FIG. 14 illustrates upper sidewalls 455 surrounding roof 468.

FIG. 15 illustrates a cross-sectional view of an embodiment of an assembled flat jet fluid nozzle 400 including the alternative embodiments of lower and upper nozzle plates 402 and 404 shown in FIGS. 13 and 14. FIG. 15 shows the cross-sectional shape of the fluid chamber 430 and chamfered lower and upper orifice edges 450 and 472.

The embodiments of flat jet fluid nozzles 100, 200, 300 and 400 discussed above all include impingement surfaces having radial flutes 160. Alternative embodiments of flat jet fluid nozzles may have flat or smooth impingement surfaces that may produce more ligature of the fluid droplet spray initially before further atomizing in the atmosphere and, thus achieve a distinct spray pattern relative to nozzles having radial flutes 160.

Figure 16:
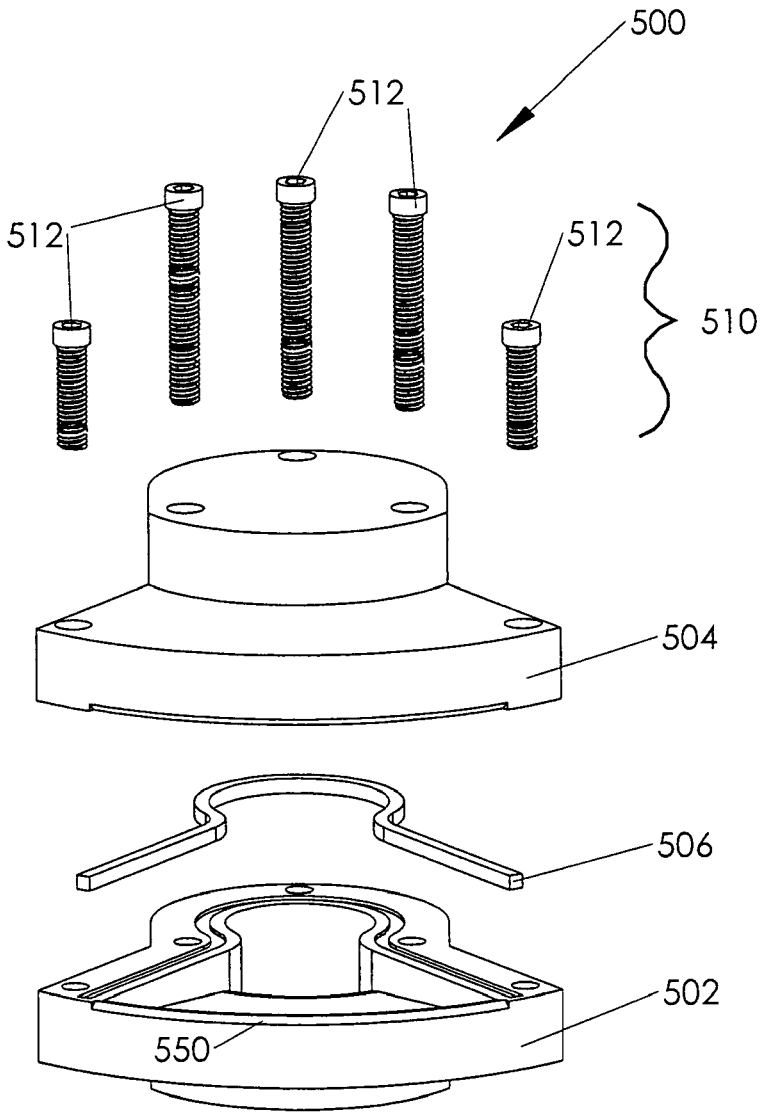
FIG. 16 illustrates an exploded view of an embodiment fixed spray angle flat jet fluid nozzle, according to the present invention.

FIG. 16 illustrates an exploded perspective view of an embodiment fixed spray angle flat jet fluid nozzle 500, according to the present invention. Nozzle 500 may include a lower nozzle plate 502, and upper nozzle plate 504, a seal 506 and a droplet size adjustment mechanism, shown generally at bracket 510. The droplet size adjustment mechanism 510 may be a plurality of bolts 512 each of suitable size, strength and length for securing the lower nozzle plate 502 to the upper nozzle plate 504 with a compressible seal 506 in between. Seal 506 may be formed of any suitable elastically deformable material similar to seal 106 described above. Thus, nozzle 500 has adjustable fluid droplet size capability just like previous nozzles 100, 200, 300 and 400 described above. However, nozzle 500 is intended to have a fixed spray angle, as there is no cover used to mask portions of the slotted orifice.

Figure 17:
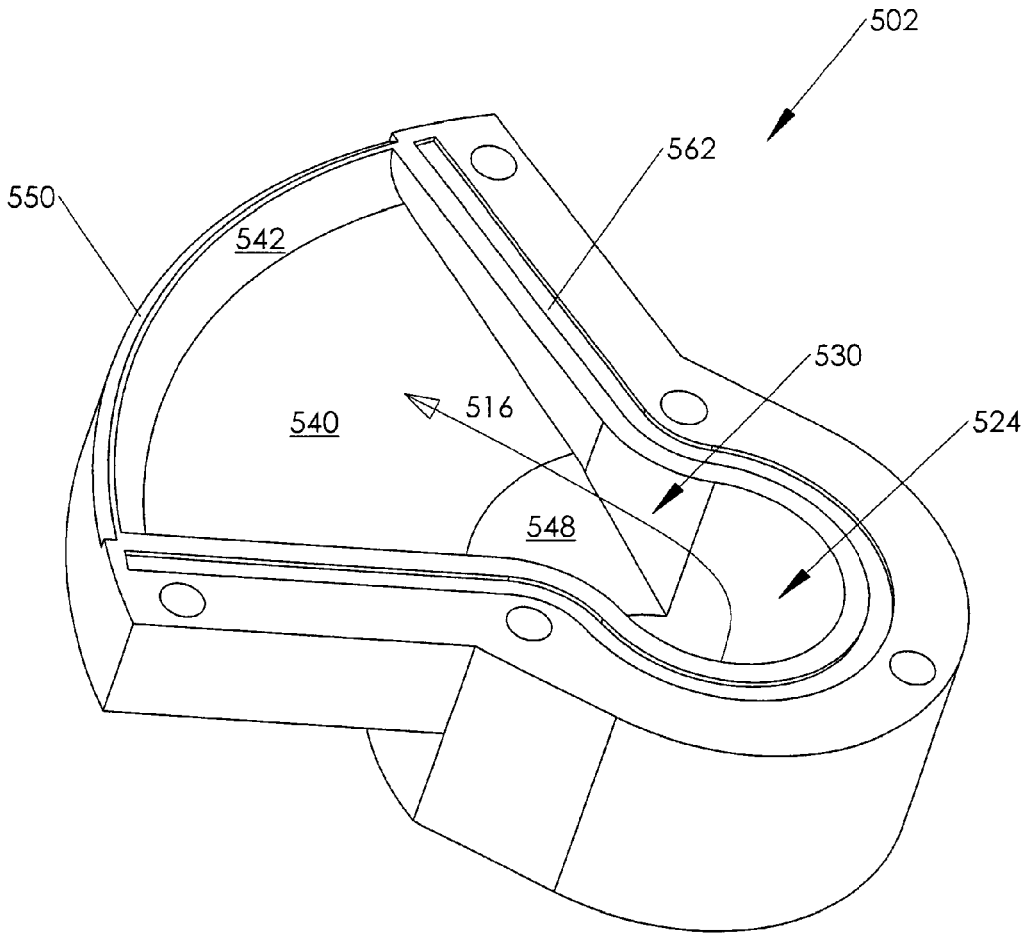
FIG. 17 illustrates a top-right perspective view of the embodiment of a lower nozzle plate shown FIG. 16 in greater detail, according to the present invention.

Referring additionally to FIG. 17, a top-right perspective view of an embodiment of a lower nozzle plate 502 is shown in greater detail, according to the present invention. Lower nozzle plate 502 may include a fluid intake port 524 leading to rounded inner edge 548, then to a linear first region 540, followed in the fluid channel, shown generally at curved arrow 516, by a nonlinear second region 542 and ending at a chamfered lower orifice edge 550. First and second regions 540 and 542 are smooth without flutes 160 (FIG. 5) but otherwise narrow the height of the fluid chamber 530 in the same fashion as achieved for the previous nozzles 100, 200, 300 and 400 described above. Lower nozzle plate 502 may further include a seal seat 562 for receiving seal 506 (FIG. 16).

Figure 18:
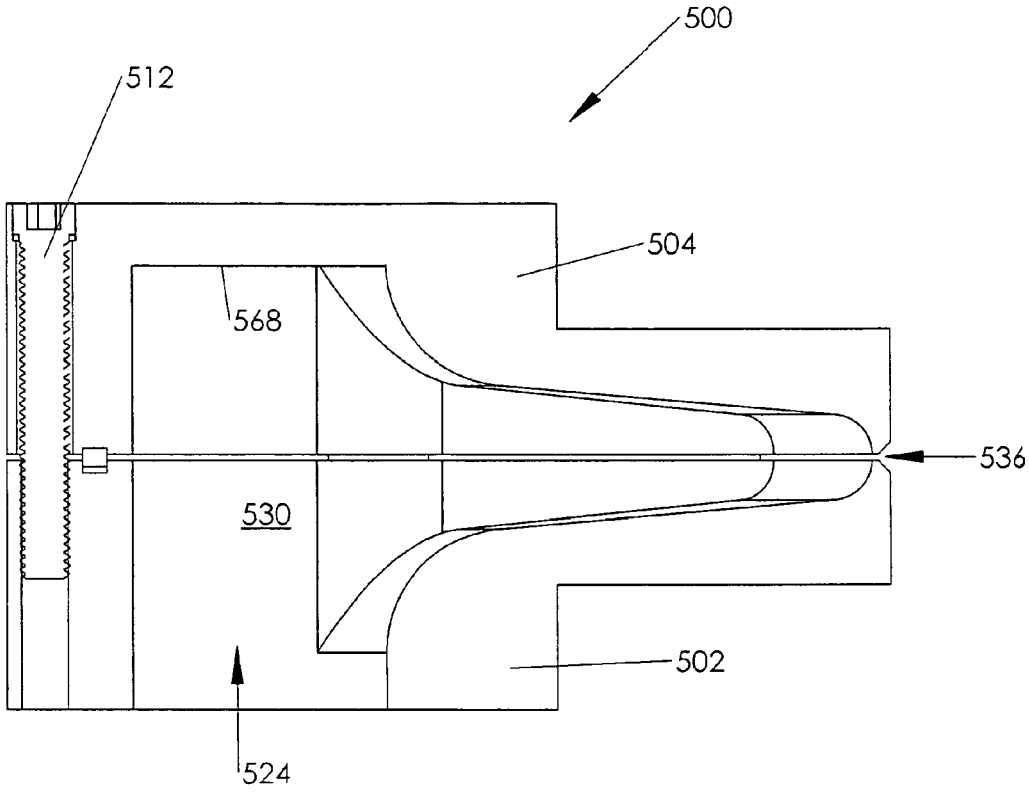
FIG. 18 is a cross-sectional side view of an embodiment of an assembled fixed spray angle flat jet fluid nozzle, according to the present invention.
Figure 19:
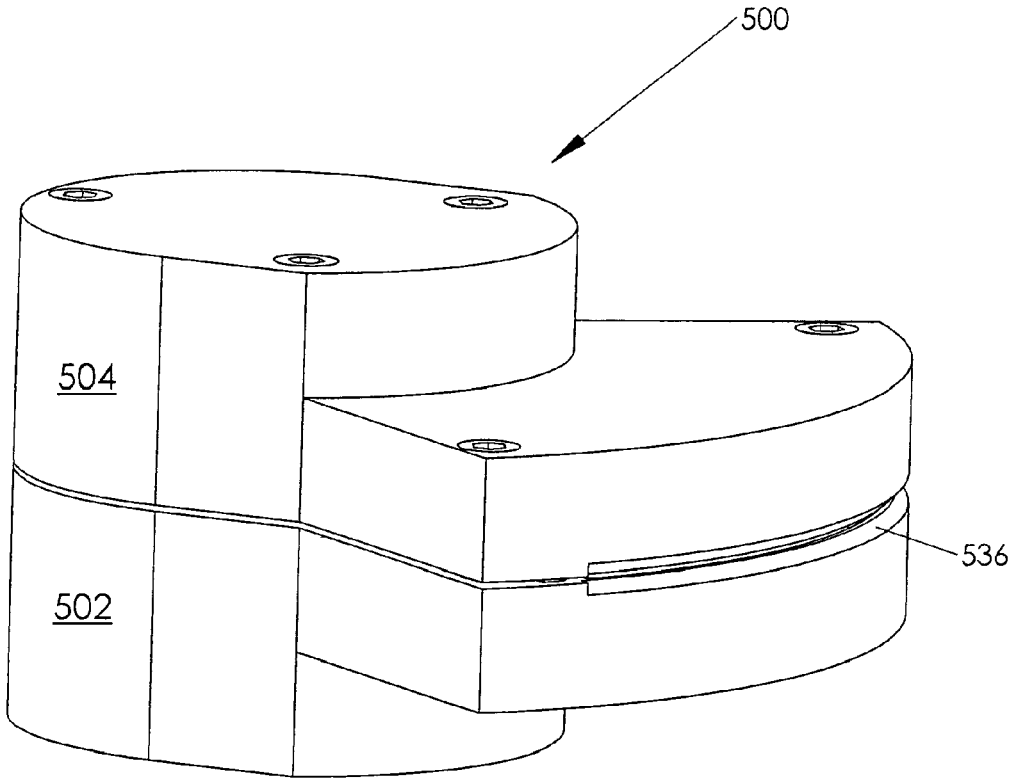
FIG. 19 is a left perspective view of the assembled fixed spray angle flat jet fluid nozzle shown in FIG. 18, according to the present invention.

FIG. 18 is a cross-sectional side view of an embodiment of an assembled fixed spray angle flat jet fluid nozzle 500, according to the present invention. As shown in FIG. 18, upper nozzle plate 504 is nearly symmetric to lower nozzle plate 502 except it lacks fluid intake port 524 and has a roof 568 instead. FIG. 19 is a left perspective view of the assembled fixed spray angle flat jet fluid nozzle 500 shown in FIG. 18, according to the present invention. As shown in FIG. 19, lower and upper nozzle plates mate together to form slotted orifice 536.

The nozzles 100, 200, 300, 400 and 500 disclosed above all include a single fluid intake port. However, other embodiments of flat jet fluid nozzles may have a plurality of fluid intake ports. Multiple fluid intake ports may allow greater flexibility in controlling fluid flow rate through the nozzle. Also, if one fluid source becomes unavailable, or a fluid control valve supplying the fluid fails, the nozzle with multiple fluid intake ports may still be still function on the other intake ports. Additionally, the plurality of intake ports need not all feed the same fluid chamber according to other embodiments of the present invention.

Figure 20:
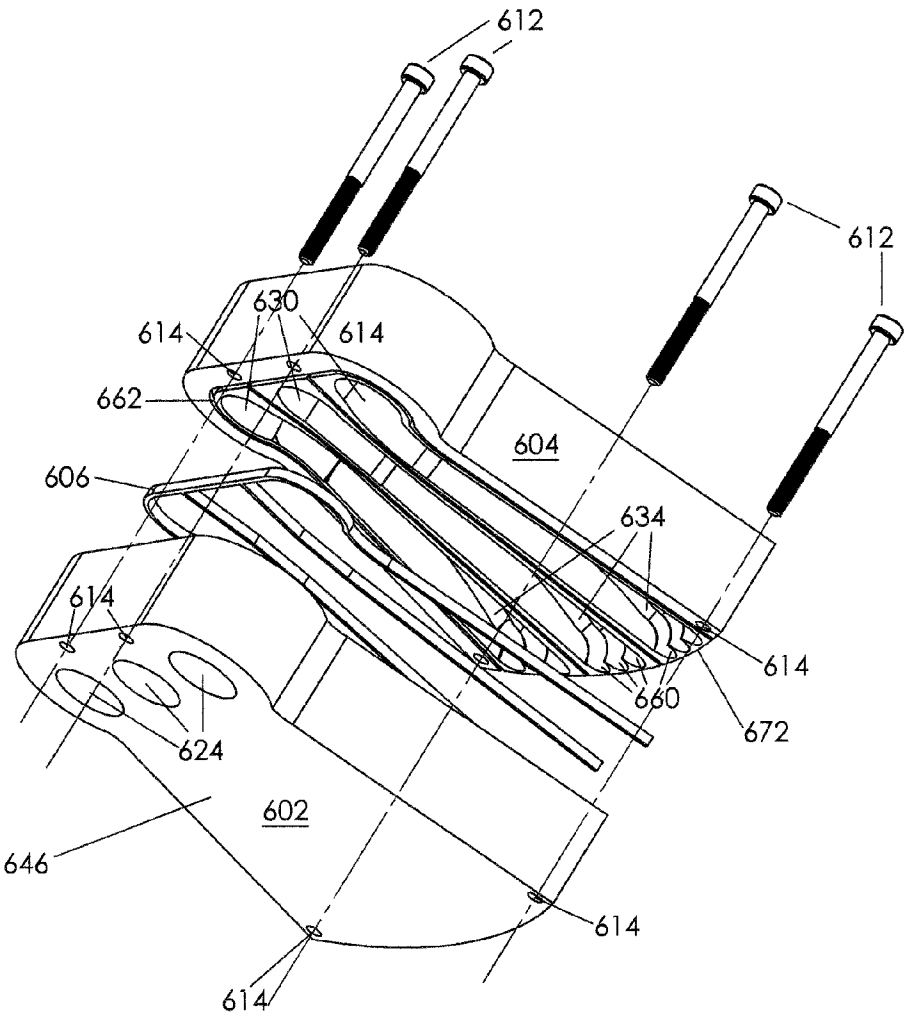
FIG. 20 is a simplified drawing of embodiments of lower and upper nozzle plates for a three chambered, shown in left perspective view, fixed spray angle nozzle, according to the present invention.

FIG. 20 is a simplified drawing of embodiments of lower and upper nozzle plates 602 and 604 for use in constructing a three chambered fixed spray angle nozzle, according to the present invention. The nozzle plates 602 and 604 are shown in left perspective exploded view. Lower nozzle plate 602 has three fluid intake ports 624 passing through bottom surface 646. Upper nozzle plate 604 shows upper portions of three fluid chambers 630, each fluid chamber 630 defined in part by an upper impingement surface 634 with three flutes 660 extending to a common upper orifice edge 672.

Figure 21:
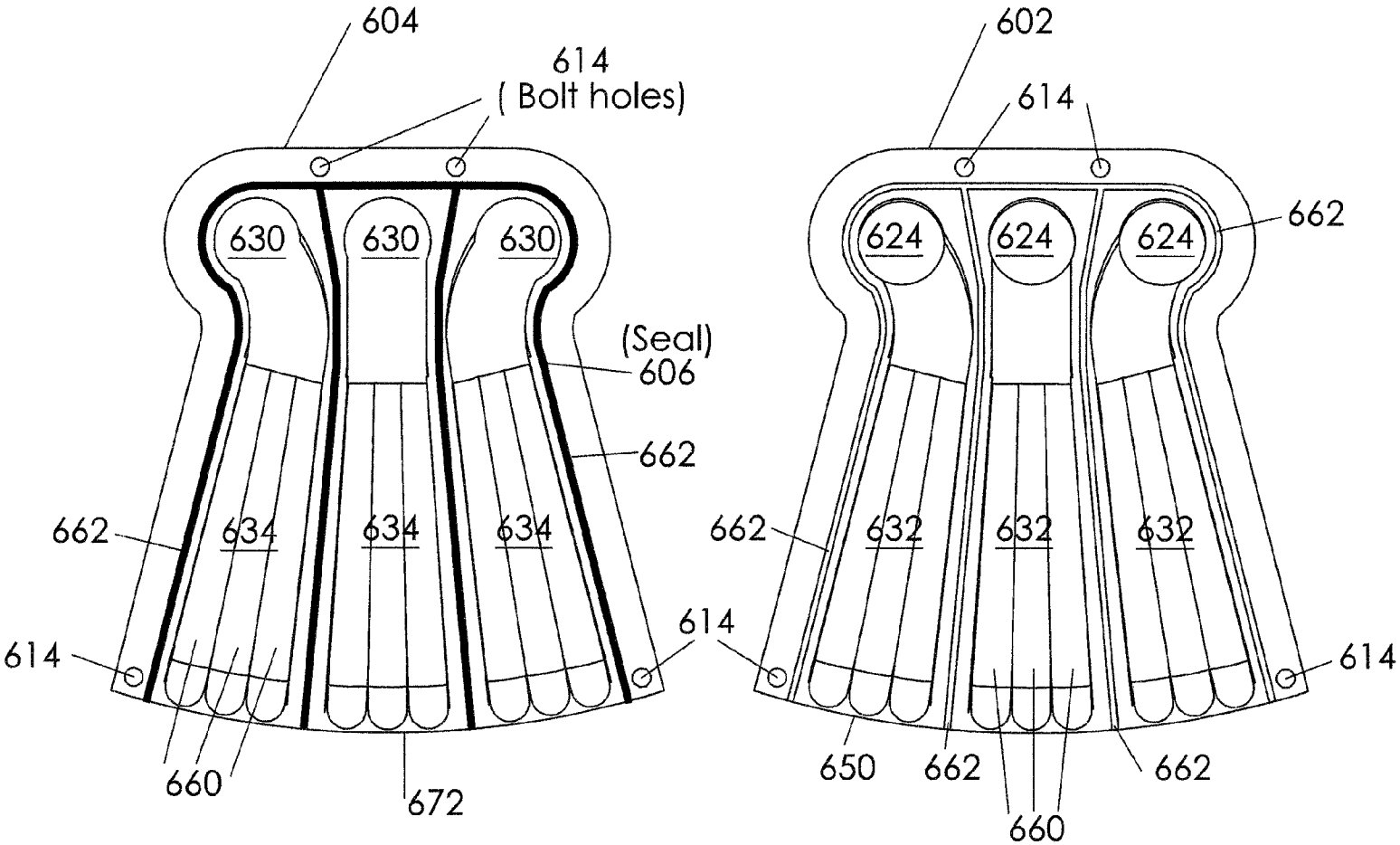
FIG. 21 illustrates greater detail of the impingement surfaces formed in the lower and upper nozzle plates shown in FIG. 20.

Referring also to FIG. 21, the impingement surfaces formed in the nozzle plates 602 and 604 of FIG. 20, are shown from above and below, respectively. Lower nozzle plate 602 includes three lower impingement surfaces 632, corresponding to the three upper impingement surfaces 634 of upper nozzle plate 604. Lower nozzle plate 602 further includes three flutes 660 formed along each of the three upper impingement surfaces 632, the flutes 660 ending at lower orifice edge 650.

It will be understood that lower and upper nozzle plates 602 and 604, shown in FIGS. 20 and 21 are simplified for purposes of illustrating variations on the number of fluid intake ports, fluid chambers and quantity of fluting on the impingement surfaces. Thus, lower and upper nozzle plates 602 and 604 are shown without other previously disclosed features to simplify the illustration and discussion of a three chambered fixed spray angle nozzle embodiment, according to the present invention. As shown in FIGS. 20 and 21, a compressible seal 606 may be configured to rest in a seal seat 662 formed around the impingement surfaces 632 and 634 which form each of the three independent fluid chambers and associated fluid intake ports 624. The compressible seal 606 may be disposed between lower and upper nozzle plates 602 and 604 and selectively compressed using bolts 612 and mounting holes 614 for securing lower and upper nozzle plates 602 and 604 to one another and thereby allowing for a distance between the opposed lower and upper orifice edges of the slotted orifice to be selectively adjustable, in a manner similar to nozzles 100 and 500 described previously. Furthermore, it will be understood that impingement surfaces 632 and 634 may have the same vertical sloping characteristics of other impingement surfaces described herein. Note also that the orifice edges 650 and 672 may be unchamfered (shown) or chamfered (not shown) according to particular embodiments of such a three chambered fixed spray angle nozzle formed from plates 602 and 604.

Figure 22:
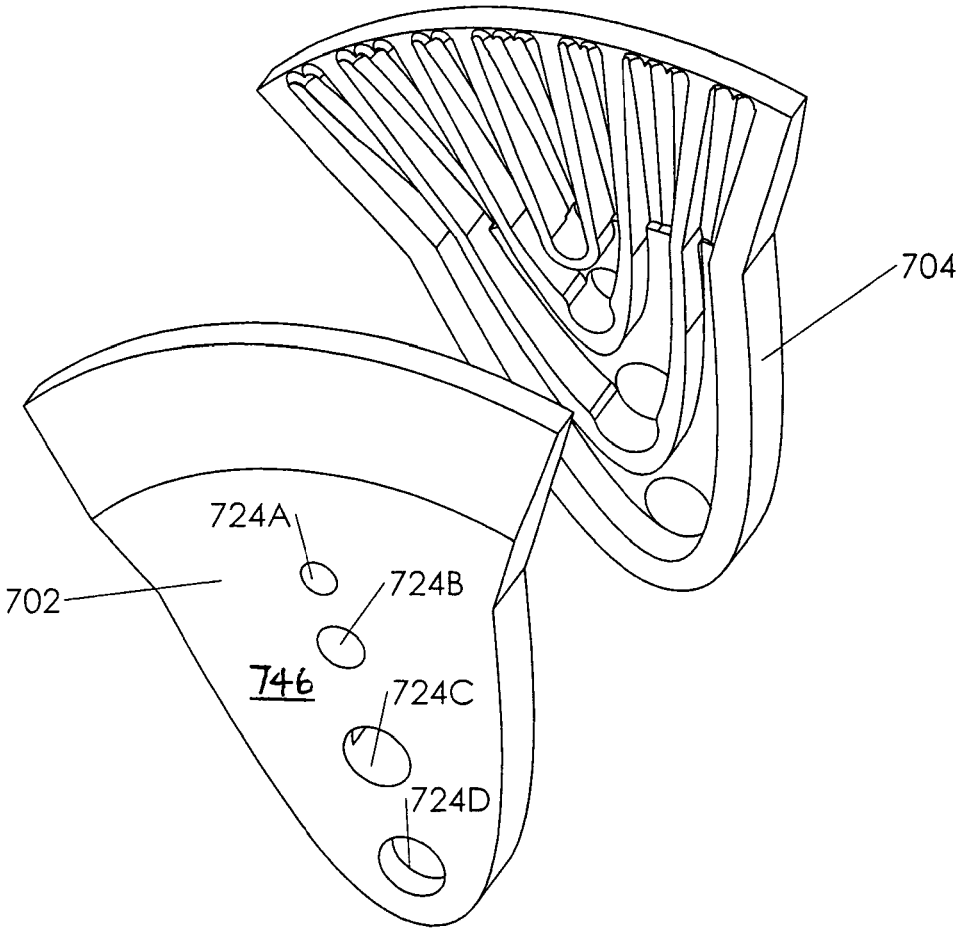
FIG. 22 illustrates an exploded perspective view of lower and upper nozzle plates for a flat jet fluid nozzle having four fluid intake ports, according to the present invention.

Other quantities and arrangements of fluid intake ports and their associated fluid channels are within the scope of the present invention. For example, FIG. 22 illustrates an exploded perspective view of lower and upper nozzle plates 702 and 704 for use in constructing a flat jet fluid nozzle, indicated generally at 700, having four fluid intake ports, according to the present invention. It will be understood that FIGS. 22-25 are "simplified" in the sense that the bolts, bolt holes, seals and other necessary features for a working nozzle 700 have been removed from the drawings to focus this description on the structure of the fluid channels. Furthermore, the application of such necessary features to make nozzle 700 fully functional will be readily apparent to one of ordinary skill in the art in view of this disclosure.

Referring again to FIG. 22, the lower and upper nozzle plates 702 and 704 are shown in lower right perspective view. Lower nozzle plate 702 has four fluid intake ports 724A-D passing through the bottom surface 746, each of which may be of a different size if desired. Note that the four fluid intake ports 724A-D are serially oriented, but transverse relative to the three fluid intake ports (624) of the three chambered fixed spray angle nozzle embodiment shown in FIGS. 20 and 21. As the lower and upper nozzle plates 702 are generally symmetrical, except for the intake ports 724A-D passing through lower nozzle plate 702 that is closed in upper nozzle plate 704, further detailed description will be with regard to the lower nozzle plate 702, only.

Figure 23:
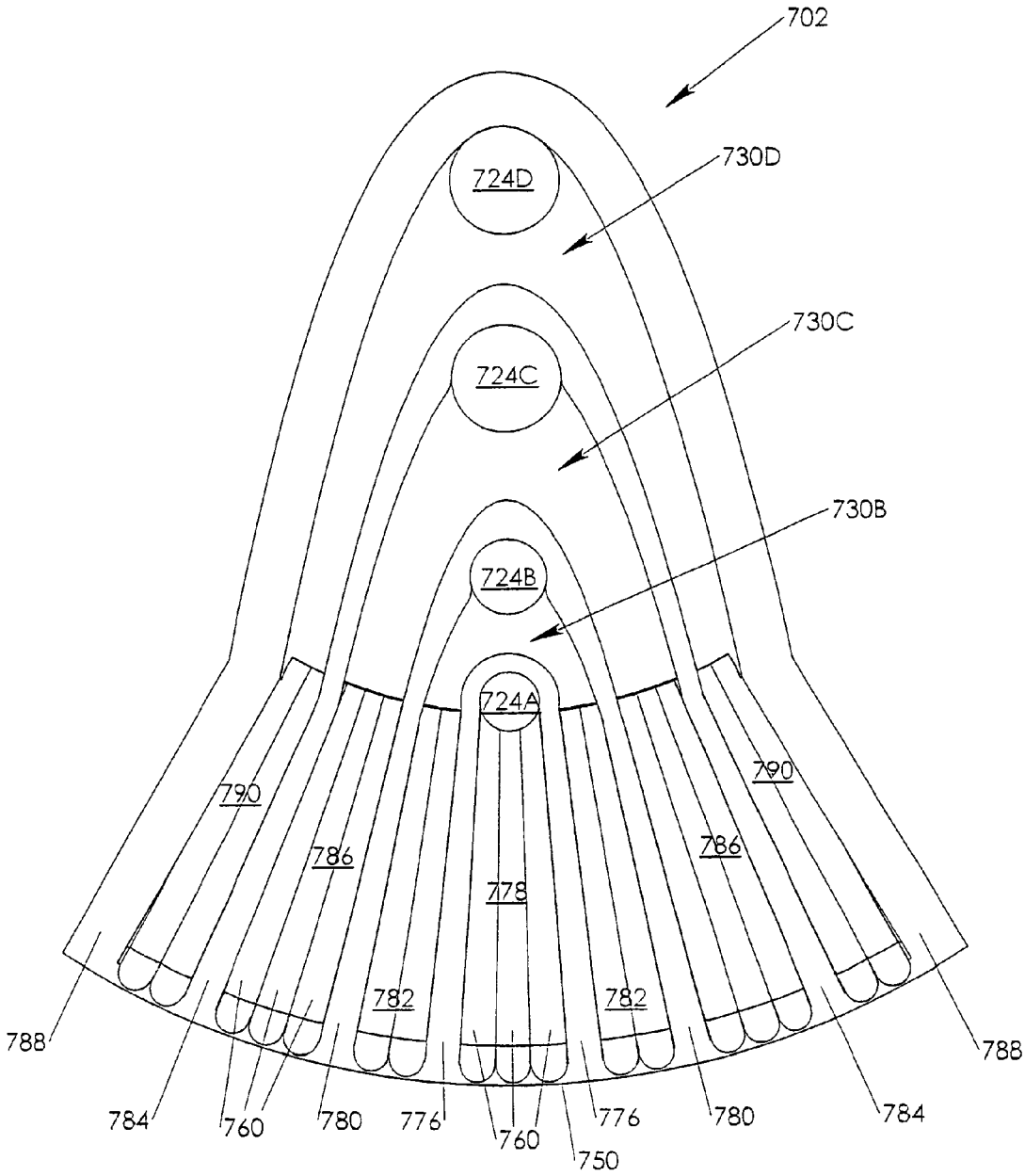
FIG. 23 is a top view of the embodiment of a lower nozzle plate shown in FIG. 22, according to the present invention.

FIG. 23 is a top view of the embodiment of a lower nozzle plate 702 shown in FIG. 22. Fluid intake port 724A is surrounded by generally inverted U-shaped wall 776 that surrounds central lower impingement surface 778 having three radial flutes 760 extending outward toward lower orifice edge 750. Fluid intake port 724B is also surrounded by a larger generally inverted U-shaped wall 780. Note that the secondary lower impingement surface 782 bifurcates around wall 776, each bifurcated impingement surface 782 having two radial flutes 760. Similarly, fluid intake port 724C is surrounded by an even larger generally inverted U-shaped wall 784. The tertiary lower impingement surface 786 bifurcates around wall 780, each bifurcated impingement surface 786 having three radial flutes 760. Finally, fluid intake port 724D is surrounded by an external inverted U-shaped wall 788. Note that the outer lower impingement surface 790 bifurcates around wall 784, each bifurcated impingement surface 790 having two radial flutes 760.

Figure 25:
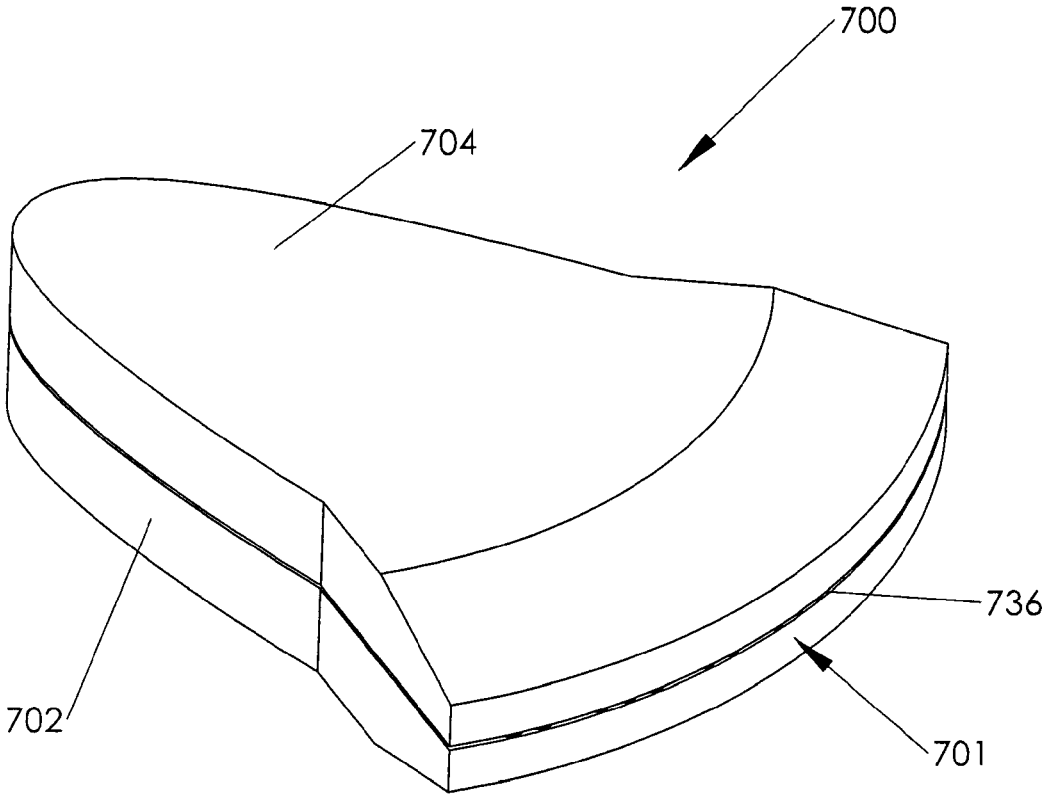
FIG. 25 is a perspective view of the flat jet fluid nozzle shown in FIGS. 22 and 24, according to the present invention.

It will be understood that symmetrical opposed impingement surfaces, walls and flutes may be formed in the upper nozzle plate 704 to complement those in the lower nozzle plate 702, thereby forming symmetrical fluid channels for fluid flowing from fluid intake ports 724A-D to the slotted orifice 736 (FIG. 25). A flat jet fluid nozzle 700 formed of lower and upper nozzle plates 702 and 704 has a balanced spray pattern, regardless of how many fluid intake ports 724A-D are engaged. This balanced spray feature results from the central positioning of the central lower impingement surface and the symmetry of the bifurcated secondary, tertiary and outer impingement surfaces.

Figure 24:
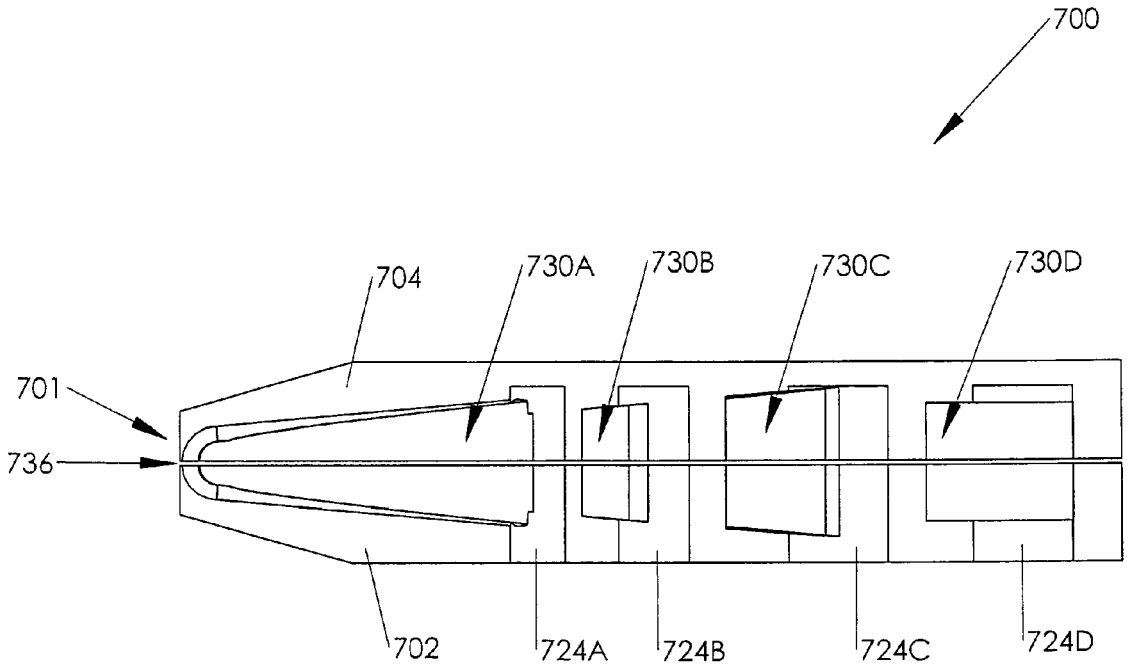
FIG. 24 is a simplified right side, cross-sectional view of the flat jet fluid nozzle of FIG. 22 as it would be assembled, according to the present invention.

FIG. 24 is a simplified right side, cross-sectional view of the flat jet fluid nozzle 700 of FIG. 22 as it would be assembled, according to the present invention. Fluid intake ports 724A-D may be formed on the bottom surface 746 of lower nozzle plate 702. Pressurized fluid (not shown) flowing into fluid intake ports 724A-D gathers into respective fluid chambers 730A-D. The fluid is then accelerated along respective opposed impingement surfaces. Streams of fluid are then opposed and impinge upon each other at slotted orifice 736 and atomize into small droplets projected into the atmosphere at high velocity. FIG. 25 is a top left perspective view of the flat jet fluid nozzle 700 shown in FIGS. 22 and 24, according to the present invention. As can be seen in FIG. 25, the slotted orifice 736 may extend in at least a portion of a semicircle around the front end 701 of nozzle 700. However, slotted orifices need not fall along a perimeter of circle of a given radius according to other embodiments of the present invention.

Figure 26:
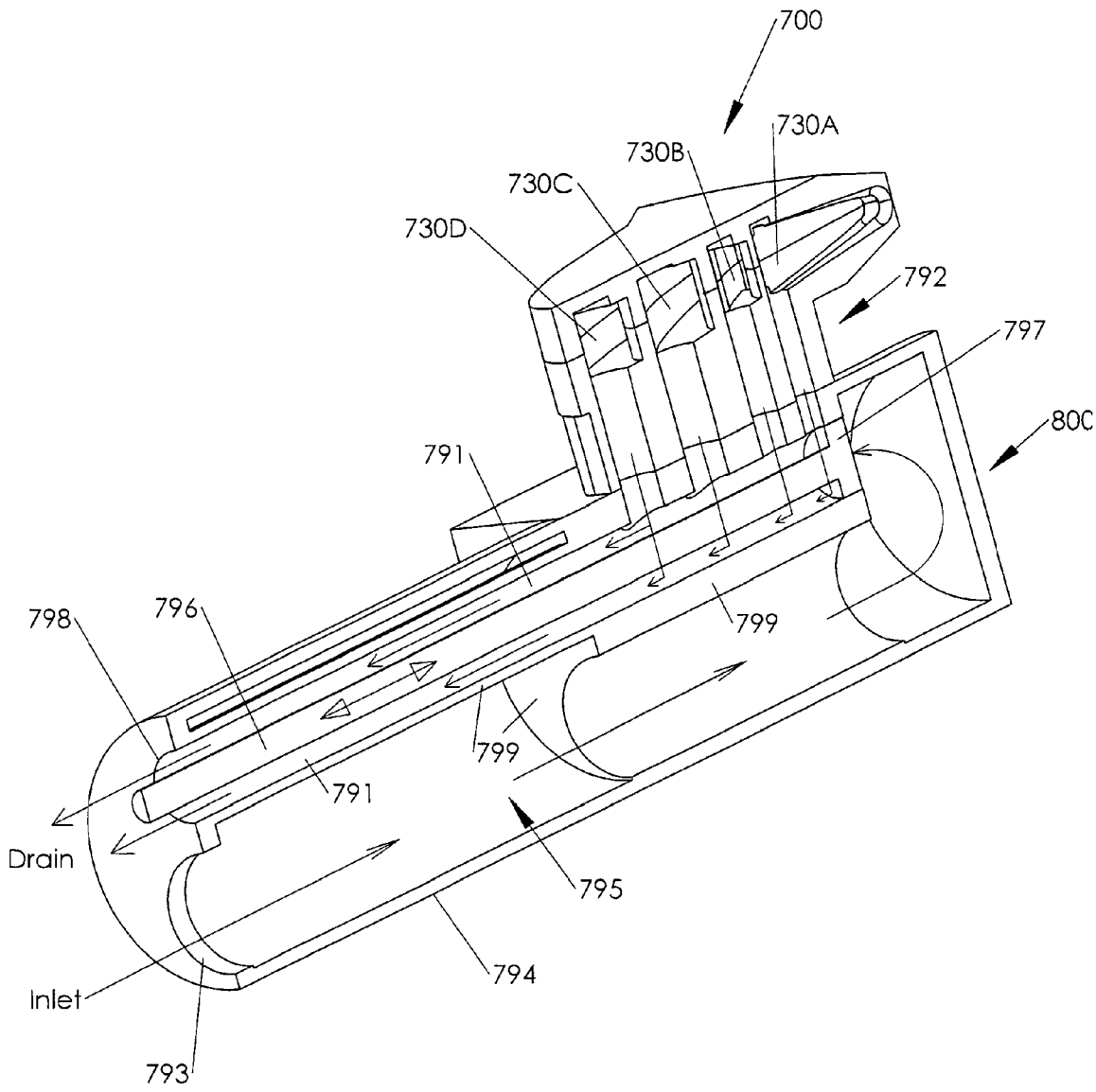
FIGS. 26 and 27 illustrate cross-sectional perspective views of an embodiment of a valve control mechanism for controlling fluid into the embodiment of a flat jet nozzle illustrated in FIGS. 22, 24 and 26.
Figure 27:
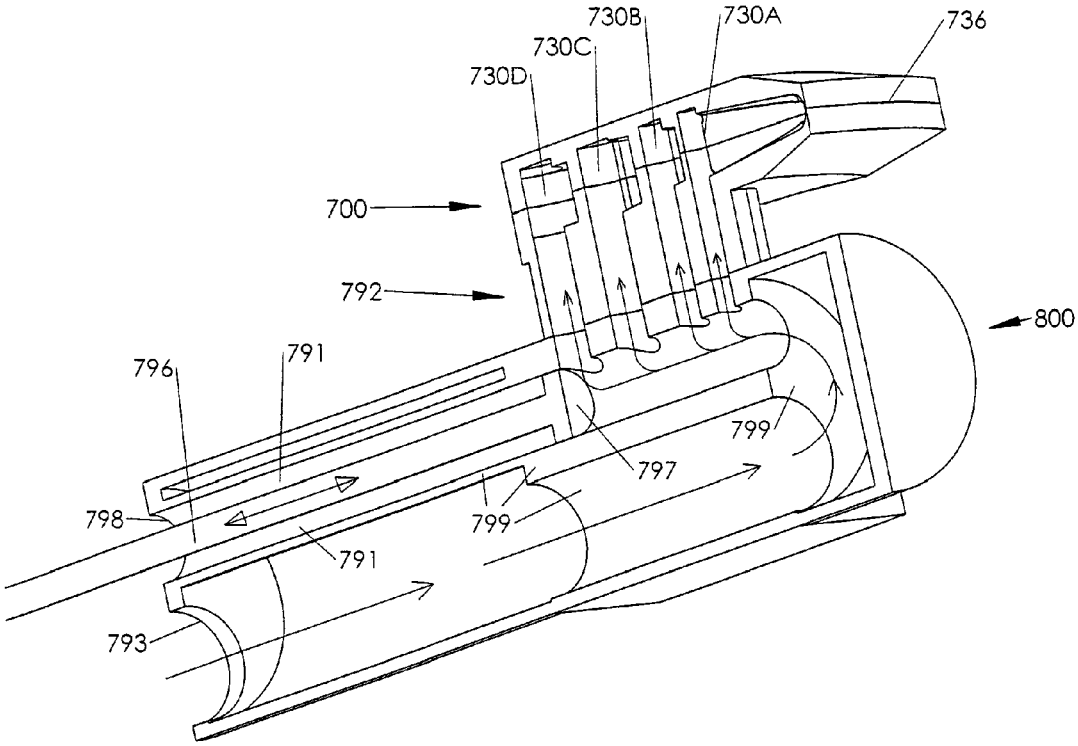

FIGS. 26 and 27 illustrate cross-sectional perspective views of an embodiment of a valve control mechanism 800 for controlling fluid entering into the embodiment of a flat jet nozzle 700 illustrated in FIGS. 22, 24 and 26. FIG. 26 illustrates a cross-sectional, left top rear perspective view of a valve control mechanism 800 attached to nozzle 700 via an intake manifold 792, shown in the "all valves closed" position. The valve control mechanism 800 includes a hollow body 794 with a fluid inlet port 793 feeding an inlet reservoir 795. Valve control mechanism 800 further includes a valve piston rod 796 with a valve piston head 797 affixed at one end of rod 796 and a fluid drain port 798 surrounding the valve piston rod 796. Valve piston rod 796 and head 797 are configured for selective movement in both directions along the axis (see double-headed arrow) of valve piston rod 796.

In the "all valves closed" position, fluid (shown diagrammatically as upper arrows traveling down and to the left) that may be left over from earlier use in the nozzle 700 flows down from the fluid chambers 730A-D and into fluid drain channel 791 that surrounds valve piston rod 796 and out of fluid drain port 798. Structural baffling 799 and valve piston head 797 separate the inlet reservoir 795 from fluid drain channel 791. Note that fluid (shown diagrammatically as lower arrows pointing to the right and up) flowing into valve control mechanism 800 through fluid inlet port 793 collects in the inlet reservoir 795, but is stopped at valve piston head 797.

FIG. 27 illustrates a cross-sectional, left bottom front perspective view of a valve control mechanism 800 attached to nozzle 700 via an intake manifold 792, in the "all valves opened" position. In the "all valves opened" position, fluid flowing through the fluid inlet port 793 into the inlet reservoir 795 and around the structural baffling 799 and up through the intake manifold 792 and into the nozzle 700 with all of its fluid chambers 730A-D and is then atomized at slotted orifice 736 as described above. Fluid flow is shown diagrammatically as arrows beginning at the fluid inlet port 793 and moving to the right and up in FIG. 27.

Fluid flow rate through nozzle 700 may thus be controlled by selective placement of the piston valve head 796 to allow water to flow into 0, 1, 2, 3 or 4 fluid intake ports 724A-D of nozzle 700. For example, in the "all valves opened" position, all of the fluid chambers 730A-D are being used along with their associated impingement surfaces to achieve maximum fluid flow. In the "all valves closed" position, fluid flow is minimized to a complete stop. Thus, any one of 5 different fluid flow rates may be established using the valve control mechanism 800 to control fluid flow rate in nozzle 700.

Of course, other fluid valving mechanisms may also be used with a multiple fluid intake port embodiment of a nozzle, e.g., nozzle 700 or one formed from opposed nozzle plates 602 and 604 (FIGS. 20 and 21), or single intake port nozzle embodiments (100, 200, 300, 400 and 500) according to the present invention. For example, individual fluid inlet pipes each having one end in fluid connection with a fluid intake port, and an opposite end including a fluid valve (manual or motor driven), would be a suitable alternative valving mechanism for use with the embodiments of nozzles disclosed herein. The workings and construction of such fluid inlet pipes and valves (not shown) are well within the knowledge of one of ordinary skill in the art and, thus, will not be further explained herein. Additional embodiments of flat jet fluid nozzles are disclosed below.

An embodiment of a flat jet fluid nozzle is disclosed according to the present invention. The embodiment of a nozzle may include a lower nozzle plate including a lower impingement surface formed therein, at least one fluid intake port disposed at an inner end of the lower impingement surface and a lower orifice edge disposed along an outer end of the lower impingement surface. The embodiment of a nozzle may further include an upper nozzle plate including an upper impingement surface formed therein and an upper orifice edge disposed along an outer end of the upper impingement surface. The embodiment of a nozzle may further include a seal configured for sealing the lower nozzle plate to the upper nozzle plate, such that the lower and upper impingement surfaces are opposed toward one another, thereby forming a fluid channel between the impingement surfaces, the fluid channel configured to direct pressurized fluid from the at least one fluid intake port to a slotted orifice formed between the opposed lower and upper orifice edges. The embodiment of a nozzle may further include a droplet size adjustment mechanism configured for attachment to the upper and lower nozzle plates for selectively controlling fluid droplet size ejected from the slotted orifice.

According to another embodiment the nozzle may further include a cover configured for surrounding the lower nozzle plate, the seal and the upper nozzle plate. The cover may include an opening configured to selectively cover or expose the slotted orifice to produce an adjustable spray angle of a fluid particle jet expelled from the slotted orifice.

According to still another embodiment the lower and upper impingement surfaces may each include a plurality of sculpted radial flutes. Each flute may emanate from a central axis passing through the lower and upper nozzle plates and extending to the orifice edges at the slotted orifice. According to other embodiments each flute may simply run generally parallel to one another, see FIGS. 20-21 and related discussion.

According to another embodiment the nozzle may further include chamfers formed in the orifice edges adjacent to outside the impingement surfaces, each chamfer opposed to each other and forming aligned half-oval pairs where each chamfer intersects with vertically aligned flutes, each vertically aligned half-oval pair forming a vertically aligned mini flat jet nozzle.

According to another embodiment of a nozzle, the fluid channel may further include a fluid chamber for receiving fluid from the at least one fluid intake ports and directing the fluid toward a central axis of the lower and upper nozzle plates.

According to yet another embodiment of a nozzle, the fluid channel may further include gradual horizontal widening of the fluid chamber from the at least one fluid intake port toward the central axis of the lower and upper nozzle plates.

According to still another embodiment of a nozzle, the fluid channel may further include a gradual narrowing followed by gradual widening of the fluid chamber from the at least one fluid intake port toward the central axis of the lower and upper nozzle plates.

According to another embodiment of a nozzle, the fluid channel may further include a gradual narrowing of the height of the fluid channel in a first region extending from the central axis of the lower and upper nozzle plates to near the slotted orifice.

According to yet another embodiment of a nozzle, the fluid channel may further include an increased narrowing of the height of the fluid channel in a second region outside of the first region and extending to the slotted orifice, such that laminar fluid flowing along the lower and upper impingement surfaces impinge upon each other at the slotted orifice and atomize into droplets of fluid upon ejection from the slotted orifice.

According to one embodiment of a nozzle, the lower and upper nozzle plates may be circular and disk-shaped. According to another embodiment of a nozzle, the at least one fluid intake port may be a single fluid intake port configured for connection to a source of high pressure fluid.

According to yet another embodiment of a nozzle, the lower and upper nozzle plates may each include a cylindrical portion attached to a fan-shaped portion extending away from the cylindrical portion, the cylindrical portions forming the slotted orifice.

According to still another embodiment of a nozzle, the seal may include an elastically deformable material capable of forming a fluid-tight seal between the lower and upper nozzle plates. According to another embodiment of a nozzle, According to another embodiment of a nozzle, the seal may be an elastomer or rubber material.

According to another embodiment of a nozzle, the droplet size adjustment mechanism may include a plurality of corresponding bolt holes formed in the lower and upper nozzle plates, the adjustment mechanism further comprising a plurality of bolts configured for securing the seal between the lower and upper nozzle plates, the bolts providing selective compression of the seal separating the lower and upper nozzle plates, thereby providing selective adjustment of a distance separating the opposed lower and upper orifice edges defining the slotted orifice.

According to still another embodiment, a flat jet fluid nozzle may include opposed lower and upper nozzle plates having a plurality of fluid intake ports leading to a plurality of fluid chambers, each of the plurality of fluid chambers comprising opposed impingement surfaces having first and second regions for accelerating fluid flow along the opposed impingement surfaces and causing opposed streams of fluid to exit opposed orifice edges and impinge upon one another, the distance between opposed orifice edges selectively adjustable.

According to a further embodiment, the first region narrows in height linearly in the direction from an intake port toward the slotted orifice. According to yet a further embodiment, the second region narrows in height nonlinearly in the direction from the first region to the slotted orifice. According to still a further embodiment, the plurality of fluid intake ports comprises three laterally aligned intake ports and smooth frustoconical impingement surfaces.

According to a further embodiment, the plurality of fluid intake ports may include four longitudinally and serially aligned intake ports in fluid connection with a valve control mechanism, the valve control mechanism comprising a hollow body enclosing an inlet reservoir separated from a fluid drain channel by a valve piston head, the valve piston head configured to selectively provide a fluid connection between zero to four of the serially aligned intake ports and the inlet reservoir. According to a further embodiment of a nozzle, the opposed impingement surfaces may further include radial flutes extending along the first and second regions of the impingement surfaces.

The fluid intake ports described herein have been described as passing through the bottom surfaces of the various lower nozzle plates described herein. It should be readily apparent that the fluid intake ports could be located in any suitable location on structure forming a nozzle consistent with the principles of the present invention, e.g., and not by way of limitation, the fluid intake port(s) may be located on the top of an upper nozzle plate or at the rear or side of either nozzle plate, according to other embodiments of the present invention. Furthermore, the nozzles described herein have all included two (lower and upper) nozzle plates. Integral nozzles formed of a unitary material or two or more components welded together, or more than two plates bolted together would all be suitable alternative embodiments for forming nozzles according to the present invention. Finally, it will be understood that any number of fluid chambers and inlet ports may be used in the construction of flat jet fluid nozzles according to embodiments of the present invention.

The embodiments of flat jet fluid nozzles disclosed herein and their components may be formed of any suitable materials, such as aluminum, copper, stainless steel, titanium, carbon fiber composite materials and the like. The component parts may be manufactured according to methods known to those of ordinary skill in the art, including by way of example only, machining and investment casting. Assembly and finishing of nozzles according to the description herein is also within the knowledge of one of ordinary skill in the art and, thus, will not be further elaborated herein.

In understanding the scope of the present invention, the term "fluid channel" is used to describe a three-dimensional space between nozzle plates that begins and a fluid intake port and ends at a slotted orifice. In understanding the scope of the present invention, the term "fluid chamber" is used herein synonymously with the term "fluid channel". In understanding the scope of the present invention, the term "configured" as used herein to describe a component, section or part of a device may include any suitable mechanical hardware that is constructed or enabled to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part", "section", "portion", "member", or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions relative to the front of an embodiment of a nozzle which has a slotted orifice as described herein. Finally, terms of degree such as "substantially", "about" and "approximately" as used herein mean a reasonable amount of deviation of the modified term such that the end result is not significantly changed.

While the foregoing features of the present invention are manifested in the detailed description and illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A flat jet fluid nozzle, comprising:

a lower nozzle plate including a lower impingement surface formed therein, at least one fluid intake port disposed at an inner end of the lower impingement surface and a lower orifice edge disposed along an outer end of the lower impingement surface;

an upper nozzle plate including an upper impingement surface formed therein and an upper orifice edge disposed along an outer end of the upper impingement surface, wherein the lower and upper orifice edges are opposed;

the lower and upper impingement surfaces each including a plurality of sculpted radial flutes, each flute emanating from a central axis passing through the lower and upper nozzle plates and each flute extending to the opposed lower and upper orifice edges, the opposed lower and upper orifice edges forming a slotted orifice;

a compressible seal configured for sealing the lower nozzle plate to the upper nozzle plate, such that the lower and upper impingement surfaces are opposed toward one another, thereby forming a fluid channel between the impingement surfaces, the fluid channel configured to direct pressurized fluid from the at least one fluid intake port to the slotted orifice formed between the opposed lower and upper orifice edges; and a droplet size adjustment mechanism configured for attachment to the upper and lower nozzle plates for selectively controlling fluid droplet size ejected from the slotted orifice by selectively compressing the compressible seal.

2. The nozzle according to claim 1, further comprising a cover configured for surrounding the lower nozzle plate, the seal and the upper nozzle plate, the cover including an opening configured to selectively cover or expose the slotted orifice to produce an adjustable spray angle of a fluid particle jet expelled from the slotted orifice.

3. The nozzle according to claim 1 further comprising chamfers formed in the opposed lower and upper orifice edges adjacent to outside the impingement surfaces, each chamfer opposed to each other and forming aligned half-oval pairs where each chamfer intersects with vertically aligned flutes, each vertically aligned half-oval pair forming a vertically aligned mini flat jet nozzle.

4. The nozzle according to claim 1, wherein the fluid channel further comprises a fluid chamber region for receiving fluid from the at least one fluid intake port and directing the fluid toward the slotted orifice formed between the lower and upper nozzle plates.

5. The nozzle according to claim 4, wherein the fluid channel further comprises gradual widening of the fluid chamber from the at least one fluid intake port toward the central axis of the lower and upper nozzle plates.

6. The nozzle according to claim 4, wherein the fluid channel further comprises gradual narrowing followed by gradual widening of the fluid chamber from the at least one fluid intake port toward the central axis of the lower and upper nozzle plates.

7. The nozzle according to claim 4, wherein the fluid channel further comprises a gradual narrowing of the height of the fluid channel in a first region extending from the central axis of the lower and upper nozzle plates to near the slotted orifice.

8. The nozzle according to claim 7, wherein the fluid channel further comprises an increased narrowing of the height of the fluid channel in a second region outside of the first region and extending to the slotted orifice, such that laminar fluid flowing along the lower and upper impingement surfaces impinge upon each other at the slotted orifice and atomize into droplets of fluid upon ejection from the slotted orifice.

9. The nozzle according to claim 1, wherein the lower and upper nozzle plates are circular and disk-shaped.

10. The nozzle according to claim 1, wherein the at least one fluid intake port comprises a single fluid intake port configured for connection to a source of high pressure fluid.

11. The nozzle according to claim 1, wherein the lower and upper nozzle plates each comprise a cylindrical portion attached to a fan-shaped portion extending away from the cylindrical portion, the cylindrical portions forming the slotted orifice.

12. The nozzle according to claim 1, wherein the seal comprises an elastically deformable material capable of forming a fluid-tight seal between the lower and upper nozzle plates.

13. The nozzle according to claim 1, wherein the seal is selected from the group comprising elastomer or rubber.

14. The nozzle according to claim 1, wherein the droplet size adjustment mechanism comprises a plurality of corresponding bolt holes formed in the lower and upper nozzle plates, the adjustment mechanism further comprising a plurality of bolts configured for securing the seal between the lower and upper nozzle plates, the bolts providing selective compression of the seal separating the lower and upper nozzle plates, thereby providing selective adjustment of a distance separating the opposed lower and upper orifice edges defining the slotted orifice.

15. A flat jet fluid nozzle comprising:

opposed lower and upper nozzle plates having opposed lower and upper orifice edges;

a plurality of independent fluid intake ports formed in the lower nozzle plate leading to a plurality of independent fluid chambers, each of the plurality of independent fluid chambers comprising:

opposed impingement surfaces having first and second regions for accelerating fluid flow along the opposed impingement surfaces and causing opposed streams of fluid to exit the opposed lower and upper orifice edges forming a slotted orifice and impinge upon one another;

a distance between the opposed lower and upper orifice edges of the slotted orifice selectively adjustable; and the second region narrowing in height nonlinearly in the direction from the first region to the slotted orifice.

16. The nozzle according to claim 15, wherein the first region narrows in height linearly in the direction from any one of the plurality of intake ports toward the slotted orifice.

17. The nozzle according to claim 15, wherein the plurality of fluid intake ports comprises three laterally aligned intake ports.

18. The nozzle according to claim 15, wherein the plurality of fluid intake ports comprises four longitudinally and serially aligned intake ports in fluid connection with a valve control mechanism, the valve control mechanism comprising a hollow body enclosing an inlet reservoir separated from a fluid drain channel by a valve piston head, the valve piston head configured to selectively provide a fluid connection between zero to four of the serially aligned intake ports and the inlet reservoir.

19. The nozzle according to claim 15, wherein the opposed impingement surfaces further comprise radial flutes extending along the first and second regions of the impingement surfaces.

* * * * *